US012800187B2

(12) United States Patent
Nam et al.

(10) Patent No.: US 12,800,187 B2
(45) Date of Patent: Nov. 17, 2026

(54) TANK ASSEMBLY AND BIDET INCLUDING THE SAME

(71) Applicant: COWAY Co., Ltd., Gongju-si (KR)

(72) Inventors: Dong Ik Nam, Gongju-si (KR); Sung Hee Lee, Gongju-si (KR); Sung Eun Lim, Gongju-si (KR); Sung Worl Jin, Gongju-si (KR); Jae Ho Lee, Gongju-si (KR)

(73) Assignee: COWAY Co., Ltd., Gongju-si (KR)

( * ) Notice: Subject to any disclaimer, the term of this patent is extended or adjusted under 35 U.S.C. 154(b) by 57 days.

(21) Appl. No.: 18/788,039

(22) Filed: Jul. 29, 2024

(65) Prior Publication Data

US 2025/0085020 A1 Mar. 13, 2025

(30) Foreign Application Priority Data

Sep. 7, 2023 (KR) ..... 10-2023-0118969

(51) Int. Cl.
*F24H 1/18* (2022.01)
*F24H 9/13* (2022.01)
*F24H 9/1809* (2022.01)

(52) U.S. Cl.
CPC ..... *F24H 1/181* (2013.01); *F24H 9/133* (2022.01); *F24H 9/1809* (2013.01)

(58) Field of Classification Search
CPC ..... F24H 1/181; F24H 9/133; F24H 9/1809
USPC ..... 220/567.3
See application file for complete search history.

(56) References Cited

U.S. PATENT DOCUMENTS 5,979,481 A * 11/1999 Ayresman ..... B60K 15/03 220/721
2007/0251256 A1* 11/2007 Pham ..... F25B 43/006 62/324.1
2014/0252171 A1* 9/2014 Dooley ..... B64D 37/32 44/458

(Continued)

FOREIGN PATENT DOCUMENTS

CN 111503892 A * 8/2020 ..... F24H 4/02
CN 111595026 A * 8/2020 ..... F24H 9/0005

(Continued)

*Primary Examiner* — Orlando E Aviles
*Assistant Examiner* — Niki M Eloshway
(74) *Attorney, Agent, or Firm* — Oblon, McClelland, Maier & Neustadt, L.L.P.

(57) ABSTRACT

A tank assembly and a bidet including the same are disclosed. The tank assembly according to one aspect of the present disclosure may include a tank member that is connected to an outside, constitutes an inlet flow path through which a fluid is introduced, and has one side in a height direction open; a cover portion that is connected to an outside, constitutes an outlet flow path of the fluid introduced into an inside, covers the one side of the tank member, and is coupled to the tank member; and an outlet buffer portion that is coupled to the cover portion to constitute the outlet flow path of the fluid together with the cover portion, and is accommodated in the tank member to be located at the one side of the tank member, wherein the outlet buffer portion may include: an outlet buffer space communicated with a cover space formed inside the cover portion; and an outlet buffer communication hole communicating the outlet buffer space with a tank space formed inside the tank member.

14 Claims, 23 Drawing Sheets

(56) References Cited

U.S. PATENT DOCUMENTS

| | | | | | |
|---|---|---|---|---|---|
| 2022/0243956 | A1* | | 8/2022 | O'Donnell | F28F 1/40 |

FOREIGN PATENT DOCUMENTS

| | | | | | |
|---|---|---|---|---|---|
| KR | 20100061981 | A | * | 6/2010 | E03D 9/08 |
| KR | 20190033230 | A | * | 3/2019 | F24H 1/105 |
| KR | 10-2019-0106464 | A | | 9/2019 | |
| KR | 10-2022-0036795 | A | | 3/2022 | |
| WO | WO-2019172644 | A1 | * | 9/2019 | F24H 9/1818 |

* cited by examiner

TANK ASSEMBLY AND BIDET INCLUDING THE SAME

CROSS-REFERENCE TO RELATED APPLICATION

This application claims priority to and the benefit of Korean Patent Application No. 10-2023-0118969, filed on Sep. 7, 2023, the disclosures of which is incorporated herein by reference in its entirety.

FIELD

The present disclosure relates to a tank assembly and a bidet including the same, and more particularly, to a tank assembly having a structure capable of improving heating efficiency of fluid and a bidet including the same.

BACKGROUND

A bidet is a type of sanitary ware, which refers to a device used to clean the genitals or anus area after toileting. In the past, the bidet was commonly installed and used in commercial buildings such as offices and hotels. Recently, as interest in hygiene has increased, the bidet has been increasingly used in ordinary homes.

The bidet is installed and used in a toilet bowl. The bidet is installed at the rear side of the bowl, which is exposed when the toilet cover is opened, and it is configured to spray water for cleaning toward the front side.

In the traditional type of bidet, raw water, that is, water supplied from a water pipe, etc., was directly discharged to perform cleaning. Therefore, there was no problem when the temperature of the raw water is relatively high, such as summer, but when the temperature of the raw water is relatively low, such as winter, there was a risk that cold water would be transmitted to the user, causing surprise or discomfort.

Therefore, recently, a bidet in a form capable of transmitting the raw water to the user by heating the provided raw water has been developed and widely used. The bidet as described above can transmit the provided raw water to the user after heating the raw water in various forms to correspond to the temperature required by the user.

As one method for heating the provided raw water and transmitting it to the outside, it is possible to consider a method equipped with a hot water tank. That is, the method is a form of heating raw water provided from the outside, accommodating the heated water in a hot water tank, and transmitting the accommodated hot water upon user's request.

In this case, since the hot water tank needs to be provided separately, there is a risk that the overall size of the bidet will increase. In addition, since power needs to be continuously supplied to maintain the temperature of the hot water accommodated in the hot water tank, it is also undesirable in terms of power efficiency.

Accordingly, recently, a bidet in the form of instantaneously heating raw water and providing it immediately upon user's request has been used. The bidet as described above can heat flowing raw water using a separate heating means and directly transmit the flowing raw water to the outside without a separate storage process.

In the above case, a heating means is provided on a member forming a flow path through which the raw water flows to heat the flowing raw water, thereby reducing the size of the tank compared to storing the heated hot water.

However, as the size of the tank decreases, the raw water may be discharged without sufficiently flowing inside the tank. In this case, since the raw water is discharged without being sufficiently heated, there is a risk that hot water at a temperature suitable for the user's needs may not be discharged.

Korean Patent Laid-Open Document No. 10-2019-106464 discloses a hot water system for a bidet including a flow path guide tank and a hot water mode method using the same. More specifically, the document discloses a hot water system for a bidet and a hot water mode method using the same, wherein the hot water system includes a flow path guide tank which forms a flow path guide hole and induces water introduced through an inlet pipe to flow toward a sheath heater, thereby sufficiently heating the introduced water.

However, the hot water system for the bidet and the hot water mode method using the same disclosed in the prior art document disclose only a method for allowing water introduced into the housing to flow toward the sheath heater. That is, the prior art document does not provide a method for mixing water at different temperatures to discharge water having a uniform temperature as a whole.

Korean Patent Laid-Open Document No. 10-2022-0036795 discloses a louver fin type heat exchanger. Disclosed is the louver pin type heat exchanger in that the delay guide pin that delays the fluid in a zigzag shape is included in the housing where the flow path is formed and maximizing the contact time for the heat exchange between the other components and the fluid flowing.

However, the louver pin type heat exchanger disclosed in the prior art document assumes that already heated fluid flows in and exchanges heat with other components. That is, the prior art document does not provide a method for sufficiently heating the fluid and forming a uniform temperature distribution to provide it to the outside.

(Patent Document 1) Korean Patent Laid-Open Document No. 10-2019-0106464 (2019.09.18.)

(Patent Document 2) Korean Patent Laid-Open Document No. 10-2022-0036795 (2022.03.23.)

SUMMARY

Technical Problem

The present disclosure is intended to solve the above problems, and it is an object of the present disclosure to provide a tank assembly having a structure capable of providing water to the outside after sufficiently heating the water, and a bidet including the same.

Another object of the present disclosure is to provide a tank assembly having a structure capable of uniformly forming the temperature of the outflowed water, and a bidet including the same.

Still another object of the present disclosure is to provide a tank assembly having a structure capable of miniaturizing a size, and a bidet including the same.

Still another object of the present disclosure is to provide a tank assembly having a structure capable of adjusting the flow rate of the outflowed water, and a bidet including the same.

Still another object of the present disclosure is to provide a tank assembly having a structure capable of achieving the above-described object without excessively changing the external structure, and a bidet including the same.

The technical problems of the present disclosure are not limited to the above-mentioned technical problems, and other technical problems not mentioned may be clearly understood by those skilled in the art to which the present disclosure pertains from the following description.

Technical Solution

According to an aspect of the present disclosure, there is provided a tank assembly including: a tank member that is connected to an outside, constitutes an inlet flow path through which a fluid is introduced, and has one side in a height direction open; a cover portion that is connected to an outside, constitutes an outlet flow path of the fluid introduced into an inside, covers the one side of the tank member, and is coupled to the tank member; and an outlet buffer portion that is coupled to the cover portion to constitute the outlet flow path of the fluid together with the cover portion, and is accommodated in the tank member to be located at the one side of the tank member, wherein the outlet buffer portion includes an outlet buffer space communicated with a cover space formed inside the cover portion; and an outlet buffer communication hole communicating the outlet buffer space with a tank space formed inside the tank member.

In this case, there may be provided a tank assembly including an outlet buffer body surrounding the outlet buffer space, wherein the outlet buffer communication hole is formed through a part of the outlet buffer body.

In addition, there may be provided a tank assembly in which the cover portion is connected to the outside at one side in its longitudinal direction, and the outlet buffer communication hole is formed at the other side in the longitudinal direction, wherein the fluid introduced into the outlet buffer space by passing through the outlet buffer communication hole flows from the other side to the one side along the longitudinal direction, and then flows out to the outside.

In this case, there may be provided a tank assembly in which the cover portion is connected to the outside at one side in its longitudinal direction, and the outlet buffer communication hole is formed in plural, and the plurality of outlet buffer communication holes are disposed to be spaced apart from each other in the longitudinal direction, wherein the sum of the cross-sectional areas of a part of the outlet buffer communication holes disposed at the one side in the longitudinal direction is less than or equal to the sum of the cross-sectional areas of the remaining outlet buffer communication holes disposed at the other side in the longitudinal direction.

In addition, there may be provided a tank assembly in which the cover portion is connected to the outside at one side in its longitudinal direction, and the outlet buffer communication hole is formed in plural, and the plurality of outlet buffer communication holes are disposed to be spaced apart from each other in the longitudinal direction, wherein the number of the outlet buffer communication holes disposed at one side in the longitudinal direction is less than or equal to the number of the outlet buffer communication holes disposed at the other side in the longitudinal direction.

In this case, there may be provided a tank assembly, including a heater portion coupled to the tank member, and configured to heat the fluid introduced into the tank space, wherein the tank member comprises a tank inlet pipe member located at the other side in the height direction and connected to the outside to constitute the inlet flow path of the fluid, wherein the heater portion is located between the tank inlet pipe member and the outlet buffer portion in the height direction.

In addition, there may be provided a tank assembly the tank inlet pipe member is located at the one side of the tank member in the longitudinal direction, wherein the outlet buffer communication hole is formed in plural, and the plurality of outlet buffer communication holes are disposed to be spaced apart from each other in the longitudinal direction, wherein the sum of the cross-sectional areas of a part of the outlet buffer communication holes disposed at the one side in the longitudinal direction is less than or equal to the sum of the cross-sectional areas of the remaining outlet buffer communication holes disposed at the other side in the longitudinal direction.

In this case, there may be provided a tank assembly in which the cover portion includes a cover body surrounding the cover space at the one side in the height direction and in the horizontal direction; and an outlet flow path coupling portion located at the one side of the cover body in the longitudinal direction, and coupled to an inlet flow path portion, and communicating the inlet flow path portion with the cover space.

In addition, there may be provided a tank assembly, including a heater portion coupled to the tank member, and configured to heat the fluid introduced into the tank space, wherein inside the outlet flow path coupling portion, a cover outlet hollow is formed through in the height direction and communicates the cover space with the outside, wherein the time for the fluid introduced into the tank space to be heated by the heater portion is increased as much as time for the fluid to flow a distance between the outlet buffer communication hole and the cover outlet hollow.

In this case, there may be provided a tank assembly, including an inlet buffer portion accommodated in the tank space to be located at the other side of the tank member in the height direction, and connected to the outside to constitute the inlet flow path of the fluid, wherein the inlet buffer portion includes a tank inlet coupling portion connected to the outside; an inlet buffer body located to be spaced apart from the other side of the tank member in the height direction; and an inlet buffer space formed between the inlet buffer body and the other side of the tank member, and connected to the tank inlet coupling portion and the tank space.

In addition, there may be provided a tank assembly in which the inlet buffer portion comprises an inlet buffer communication hole formed through the inside of the inlet buffer body, and communicating the inlet buffer space with the tank space.

In this case, there may be provided a tank assembly In which the tank inlet coupling portion is located on one side of the inlet buffer body in the longitudinal direction, and the inlet buffer communication hole is provided in plural, and the plurality of inlet buffer communication holes are disposed to be spaced apart from each other along the longitudinal direction, and the sum of the cross-sectional areas of a part of the inlet buffer communication holes disposed at the one side in the longitudinal direction is less than or equal to the sum of the cross-sectional areas of the remaining inlet buffer communication holes disposed at the other side in the longitudinal direction.

In addition, there may be provided a tank assembly in which the tank member comprises an inlet buffer support rib extending from the other side of the tank member in the height direction, and supporting the inlet buffer body.

In addition, according to an aspect of the present disclosure, there is provided a bidet including the tank assembly a fluid supply unit connected to the tank assembly and the outside, respectively, to constitute the inlet flow path of the fluid; and a fluid injection unit connected to the tank assembly and the outside, respectively, to constitute the outlet flow path of the fluid.

Advantageous Effects

According to the above configuration, the tank assembly and the bidet including the same according to the embodiment of the present disclosure may provide water to the outside after sufficiently heating the water, In addition, the tank assembly and the bidet including the same according to the embodiment of the present disclosure may uniformly form the temperature of the outflowed water.

In addition, the tank assembly and the bidet including the same according to the embodiment of the present disclosure may miniaturize a size.

In addition, the tank assembly and the bidet including the same according to the embodiment of the present disclosure may adjust the flow rate of the outflowed water.

In addition, the tank assembly and the bidet including the same according to the embodiment of the present disclosure may achieve the above-described object without excessively changing the external structure.

It should be understood that the effects of the present disclosure are not limited to the above-described effects, and include all effects that can be inferred from the detailed description of the present disclosure or the configuration of the invention described in the claims.

DETAILED DESCRIPTION

Figure 1:
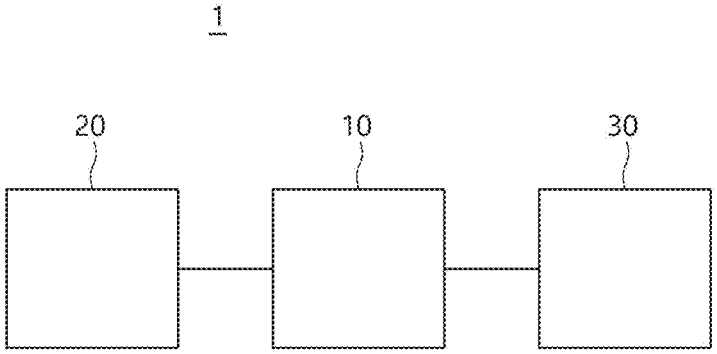
FIG. 1 is a block diagram illustrating the configuration of a bidet according to an embodiment of the present disclosure.

Hereinafter, embodiments of the present disclosure will be described in detail with reference to the accompanying drawings so that those skilled in the art can easily implement them. The present disclosure may be implemented in various different forms and is not limited to the embodiments described herein. In order to clearly explain the present disclosure, parts irrelevant to the description are omitted in the drawings, and the same or similar components are denoted by the same reference numerals throughout the entire specification.

The words and terms used in this specification and the claims are not interpreted as limited to ordinary or dictionary meanings, but should be interpreted as meanings and concepts consistent with the technical idea of the present disclosure according to the principle in which the inventor can define the terms and concepts in order to best explain their invention.

Therefore, the embodiments described in this specification and the configurations illustrated in the drawings correspond to a preferred embodiment of the present disclosure and do not all represent the technical idea of the present disclosure, so the corresponding configurations may be various equivalents and modifications to replace them at the time of filing the present disclosure.

In the following description, in order to clarify the features of the present disclosure, some components may be omitted.

The term "communication" used in the following description means that one or more members are connected to each other in fluid communication. In an embodiment, the communication may be formed by a member such as a pipe, a pipe, or a pipe. In the following description, communication may be used in the same sense that one or more members are "fluidly connected" to each other.

The term "electrical connection" used in the following description means that one or more members are connected to each other to transfer a current or electric signal. In an embodiment, the electrical connection may be formed in the form of a wire by a wire member or wireless such as Bluetooth, Wi-Fi, and RFID. In an embodiment, the electrically connection may include the meaning of "communication".

The term "fluid" as used in the following description refers to any type of material that flows by external forces and may deform shape or volume, etc. In one embodiment, the fluid may be a liquid such as water or a gas such as air.

The terms "upper side", "lower side", "left side", "right side", "front side", and "rear side" used in the following description will be understood with reference to the coordinate system shown throughout the accompanying drawings.

Referring to FIG. 1, a configuration of a bidet 1 according to an embodiment of the present disclosure is illustrated as an example. The bidet 1 according to the illustrated embodiment includes a tank assembly 10, a fluid supply unit 20, and a fluid injection unit 30.

The fluid supply unit 20 is a configuration in which the bidet 1 is fluidly connected to an outside to receive raw water. The fluid supply unit 20 may be fluidly connected with a faucet or a tap to receive the water. Alternatively, the fluid supply unit 20 may be fluidly connected to a separate container (not shown) to receive the water contained in the container (not shown).

The fluid supply unit 20 is fluidly connected to the tank assembly 10. The water provided to the fluid supply unit 20 may be transferred to the tank assembly 10.

The fluid injection unit 30 receives the water that flows out of the tank assembly 10 and discharges it to the outside of the bidet 1. The fluid injection unit 30 is fluidly connected to the tank assembly 10. As will be described later, it may be said that the water passing through the tank assembly 10 is heated and generated as hot water, and the fluid injection unit 30 may provide the generated hot water to the outside.

Figure 2:
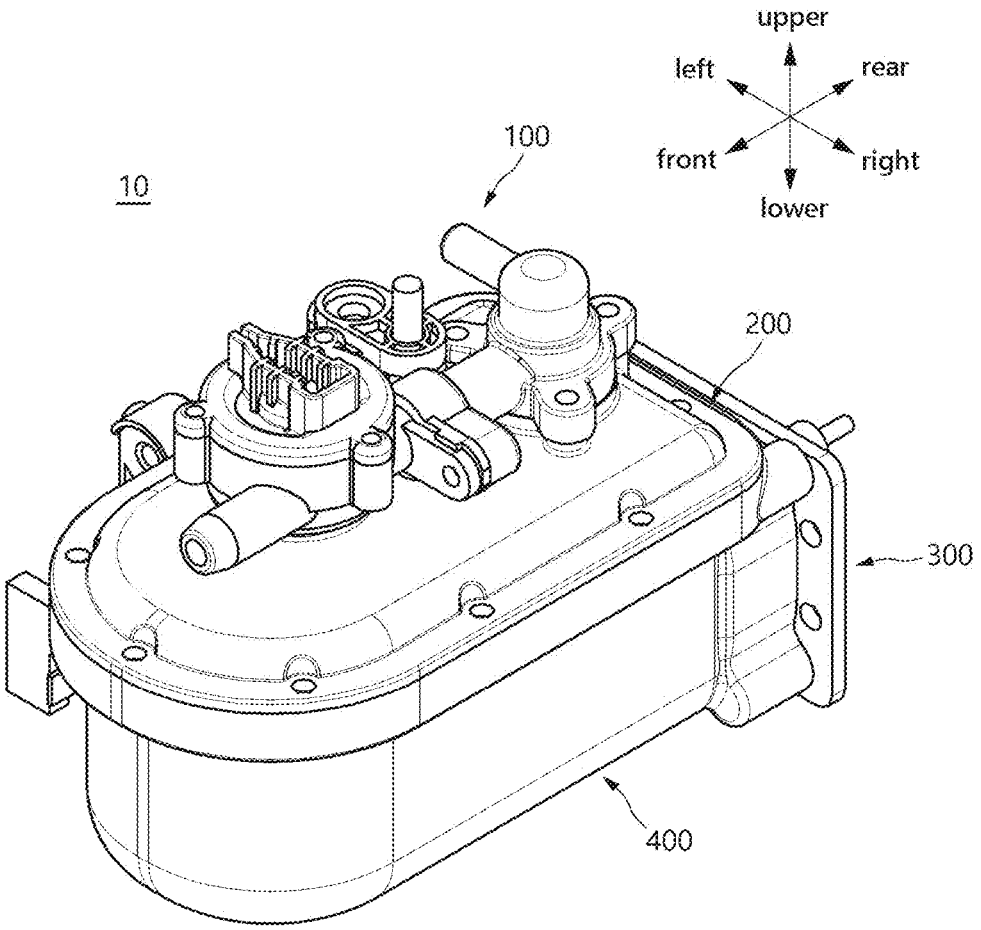
FIG. 2 is a perspective view illustrating a tank assembly provided in the bidet of FIG. 1.
Figure 3:
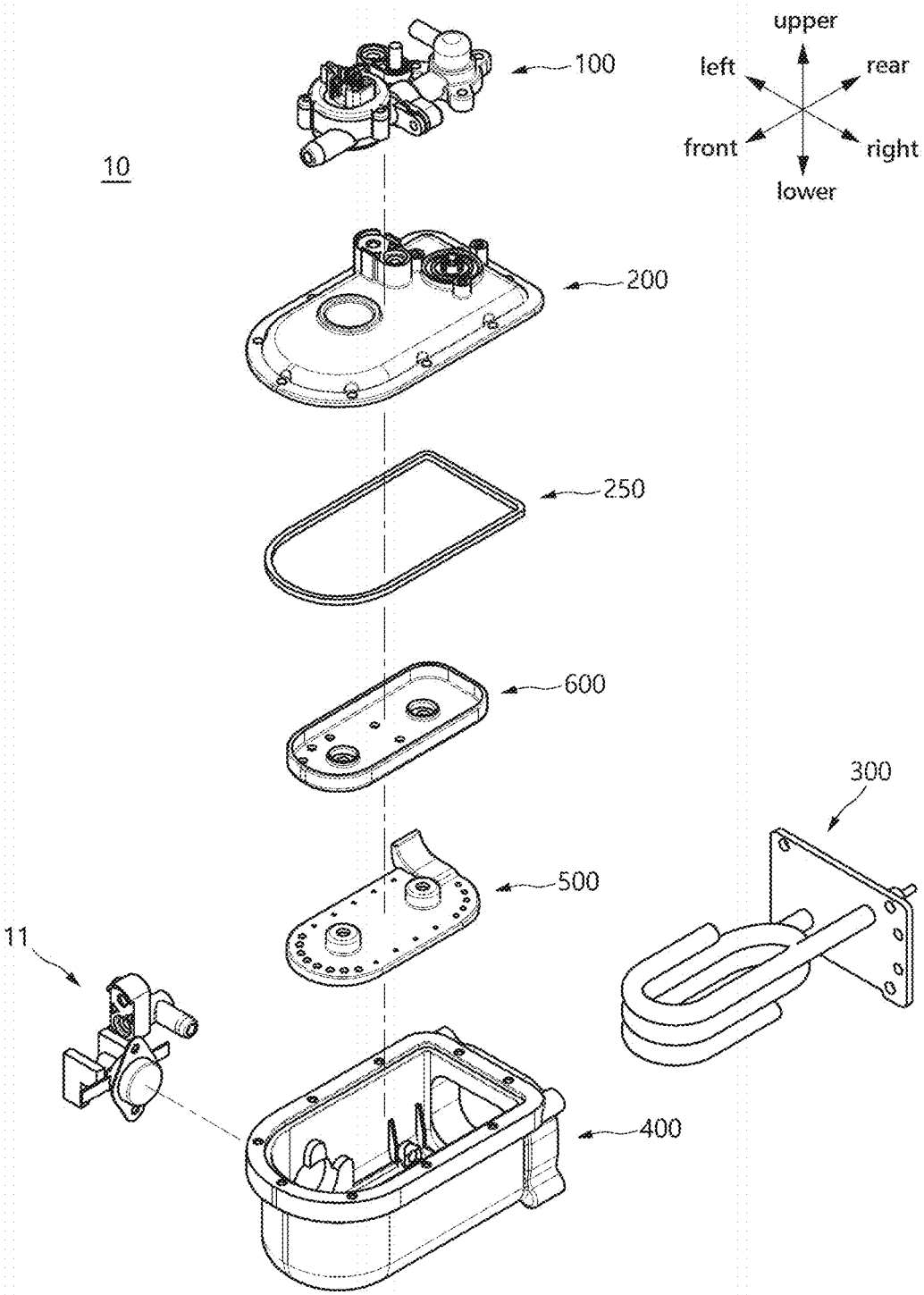
FIG. 3 is an exploded perspective view illustrating the tank assembly of FIG. 2.

Referring to FIGS. 2 and 3, the tank assembly 10 provided in a bidet 1 according to an embodiment of the present disclosure is disclosed. The tank assembly 10 is fluidly connected to the fluid supply unit 20 and the fluid injection unit 30, respectively. The water introduced through the fluid supply unit 20 passes through the tank assembly 10 and is heated, and then may be discharged to the outside through the fluid injection unit 30.

In addition, the tank assembly 10 according to the embodiment of the present disclosure may be provided in an instantaneous heating manner. In other words, the water provided from the fluid supply unit 20 may not be maintained in the state of being accommodated in the tank assembly 10, but may be provided to the outside through the fluid injection unit 30 after being heated while flowing inside the tank assembly 10.

Therefore, the size of the tank assembly 10 may be reduced compared to the case of heating the provided water and storing it.

Additionally, the tank assembly 10 according to an embodiment of the present disclosure may heat the water provided from the fluid supply unit 20 for a sufficient period of time and then provide it to the outside. To this end, the tank assembly 10 is configured such that the inflowed or outflowed water flows along a sufficiently long flow path and then flows into or out of the tank assembly 10.

Therefore, the size of the tank assembly 10 may be miniaturized and the heating effect of water may be improved. As a result, the size of the entire bidet 1 is reduced, power efficiency is improved, and user satisfaction may also be improved.

The tank assembly 10 may be fluidly connected to the fluid supply unit 20 through the inlet flow path portion 11. The inlet flow path portion 11 is coupled to the tank body 410 at one side in the width direction of the tank member 400, that is, at the left side in the illustrated embodiment. Inside the inlet flow path portion 11, the inlet flow path hollow 12 is formed through, and communicates the fluid supply unit 20 with the tank space 420 (see FIGS. 19 and 20).

In the illustrated embodiment, the tank assembly 10 includes an outlet flow path portion 100, a cover portion 200, a heater unit 300, a tank member 400, an inlet buffer portion 500, and an outlet buffer portion 600.

The outlet flow path portion 100 constitutes a part in which the tank assembly 10 is fluidly connected to the outside. The outlet flow path portion 100 constitutes a flow path through which the water heated while passing through the tank member 400 flows out to the fluid injection unit 30. The outlet flow path portion 100 is fluidly connected to the tank member 400 and the fluid injection unit 30, respectively.

The outlet flow path portion 100 is coupled to the cover portion 200. Specifically, the outlet flow path portion 100 is coupled to the upper surface of the cover body 210 that covers the tank member 400 from the upper side. The outlet flow path portion 100 is coupled to and communicates with the outlet flow path coupling portion 230 formed on the cover body 210. Accordingly, the outlet flow path portion 100 is fluidly connected to the tank space 420 formed inside the tank member 400.

The outlet flow path portion 100 may be coupled to the cover portion 200 and may be provided in any form that may be fluidly connected to the cover portion 200 and the tank space 420, respectively. In the illustrated embodiment, the outlet flow path portion 100 includes a plurality of fitting members and pipes connecting them.

Figure 4:
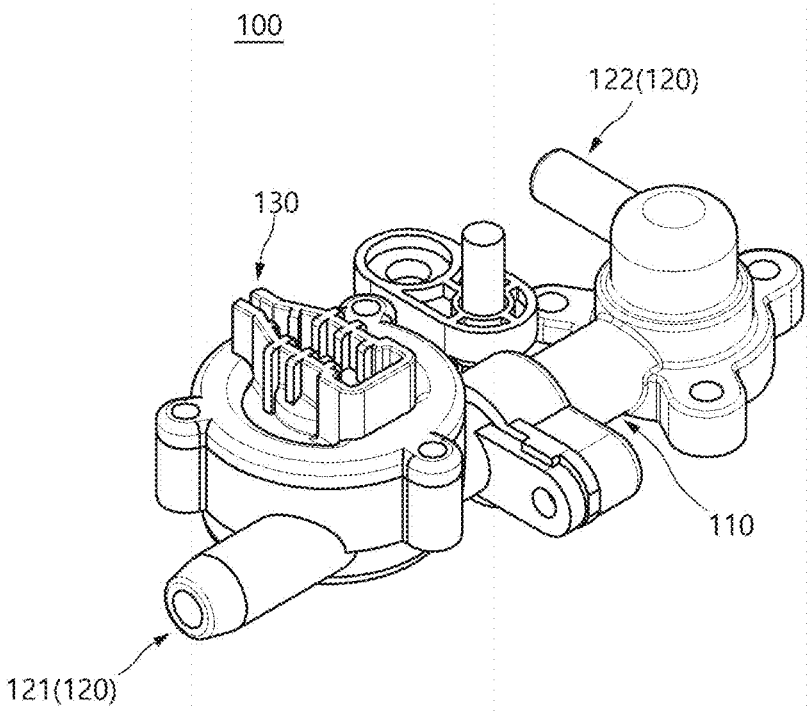
FIG. 4 is a perspective view illustrating an outlet flow path portion provided in the tank assembly of FIG. 2.
Figure 5:
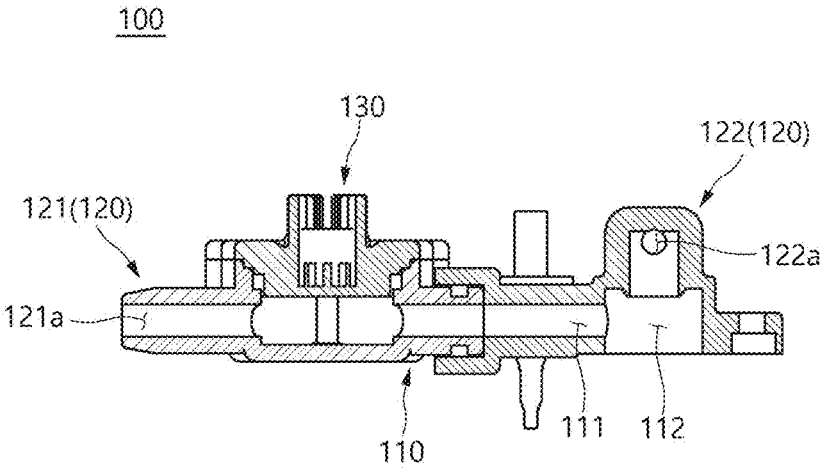
FIG. 5 is a front cross-sectional view illustrating the outlet flow path portion of FIG. 4.

In the embodiment illustrated in FIGS. 4 and 5, the outlet flow path portion 100 includes an outlet flow path body 110, an outlet pipe member 120, and a sensor coupling portion 130.

The outlet flow path body 110 constitutes a part of the outlet flow path portion 100. The outlet flow path body 110 is coupled to and communicates with other components of the outlet flow path portion 100. The outlet flow path body 110 constitutes a part of the flow path through which the water passing through the tank member 400 flows toward the fluid injection unit 30.

The outlet flow path body 110 extends in the longitudinal direction of the tank assembly 10, that is, in the front and rear directions in the illustrated embodiment. One end of the outlet flow path body 110 in the extending direction, that is, the rear end in the illustrated embodiment, is open and communicates with the outlet flow path coupling portion 230. The other end of the outlet flow path body 110 in the extending direction, that is, the front end in the illustrated embodiment, is open and communicates with the fluid injection unit 30.

The outlet flow path body 110 is coupled to the outlet pipe member 120. The outlet flow path body 110 communicates with the outlet pipe member 120, so that the water flowing in the outlet flow path body 110 may further flow along the outlet pipe member 120 and be transmitted to the fluid injection unit 30. In the illustrated embodiment, each side of the outlet flow path body 110 in the extending direction, that is, the front side and the rear side of the illustrated embodiment are coupled to and communicate with a pair of outlet pipe members 120, respectively.

The outlet flow path body 110 is coupled to the sensor coupling portion 130. In the illustrated embodiment, one point biased to the other side, that is, the front side of the outlet flow path body 110 in the extending direction, is coupled to the sensor coupling portion 130. A flow rate sensor (not shown) disposed in the sensor coupling portion 130 may sense the flow rate of water flowing along the outlet flow path body 110.

In the illustrated embodiment, the outlet flow path body 110 includes the outlet flow path body hollow 111 and the outlet opening 112.

The outlet flow path body hollow 111 is a space in which the outlet flow path body 110 communicates with the outlet pipe member 120 and the sensor coupling portion 130. The outlet flow path body hollow 111 is formed through the inside of the outlet flow path body 110. The outlet flow path body hollow 111 extends in the extending direction of the outlet flow path body 110, that is, in the front and rear directions in the illustrated embodiment.

The outlet flow path body hollow 111 may have a shape corresponding to the shape of the outlet flow path body 110.

In the illustrated embodiment, the outlet flow path body hollow 111 is formed as a cylindrical space that has a circular cross-section and extends in the front-back direction.

Each end of the outlet flow path body hollow 111 in the extending direction is formed open. One end of the outlet flow path body hollow 111 in the extending direction, that is, the front end in the illustrated embodiment, communicate with the first outlet pipe hollow 121*a* formed inside the first outlet pipe member 121. The other end of the outlet flow path body hollow 111 in the extending direction, that is, the rear end in the illustrated embodiment, communicate with the outlet opening 112.

The outlet opening 112 is a part in which the outlet flow path portion 100 is coupled to and communicates with the cover portion 200. The outlet opening 112 is coupled to the outlet flow path coupling portion 230 and communicates with the cover outlet hollow 231 formed therein. The heated water flowing in the tank space 420 may enter the outlet opening 112 through the cover outlet hollow 231.

The outlet opening 112 communicates with the outlet flow path body hollow 111. At least a part of the water entering the outlet opening 112 may enter the outlet flow path body hollow 111.

The outlet opening 112 communicates with a second outlet pipe hollow 122*a*. At least a part of the water entering the outlet opening 112 may enter the second outlet pipe hollow 122*a*.

The outlet opening 112 may be disposed at any position that may communicate with the outlet flow path body hollow 111, the outlet pipe hollows 121*a* and 122*a*, and the cover outlet hollow 231. In the illustrated embodiment, the outlet opening 112 is located at one side, that is, the rear side, of the tank assembly 10 in the longitudinal direction. The position of the outlet opening 112 may be changed to correspond to the position of the outlet flow path coupling portion 230.

The outlet pipe member 120 constitutes a flow path through which water delivered to the outlet flow path body 110 flows to the fluid injection unit 30. The outlet pipe member 120 is coupled to and communicates with the outlet flow path body 110 and the fluid injection unit 30, respectively. The water introduced into the outlet flow path body 110, that is, the heated water, may be transmitted to the fluid injection unit 30 via the outlet pipe member 120.

The outlet pipe member 120 is coupled to the outlet flow path body 110. The outlet pipe hollows 121*a* and 122*a* formed inside the outlet pipe member 120 communicate with the outlet flow path body hollow 111 or the outlet opening 112.

The outlet pipe member 120 may be provided in plural. The plurality of outlet pipe members 120 may be coupled to and communicate with the outlet flow path body 110 and the fluid injection unit 30 at different positions. In the illustrated embodiment, the outlet pipe member 120 is provided as a pair including a first outlet pipe member 121 and a second outlet pipe member 122.

The first outlet pipe member 121 is located on one side of the outlet flow path body 110 in the longitudinal direction, that is, on the front side in the illustrated embodiment. The first outlet pipe member 121 is coupled to and communicates with the one side of the outlet flow path body 110, that is, the front end. The first outlet pipe member 121 extends in the longitudinal direction of the outlet flow path body 110, that is, in the front and rear directions in the illustrated embodiment.

The first outlet pipe hollow 121*a* is formed through the inside of the first outlet pipe member 121. The first outlet pipe hollow 121*a* extends in the longitudinal direction of the first outlet pipe member 121, that is, in the front and rear directions in the illustrated embodiment. One end of the first outlet pipe hollow 121*a* in the extending direction, that is, the front end in the illustrated embodiment, are formed open and fluidly connected to the fluid injection unit 30. The other end of the first outlet pipe hollow 121*a* in the extending direction, and the rear end in the illustrated embodiment, are formed open and communicates with the outlet flow path body hollow 111.

The second outlet pipe member 122 is located on the other side of the outlet flow path body 110 in the longitudinal direction, that is, on the rear side in the illustrated embodiment. The second outlet pipe member 122 is coupled to and communicates with the other side of the outlet flow path body 11, that is, the rear end in the illustrated embodiment. The second outlet pipe member 122 extends in the width direction of the tank assembly 10, that is, in the left and right directions in illustrated the embodiment.

The second outlet pipe hollow 122*a* is formed through the inside the second outlet pipe member 122. The second outlet pipe hollow 122*a* extends in the longitudinal direction of the second outlet pipe member 122, that is, in the left and right directions in the illustrated embodiment. One end of the second outlet pipe hollow 122*a* in the extending direction, that is, the left end in the illustrated embodiment, are formed open and fluidly connected to the fluid injection unit 30. The lower side of the other end in the extending direction of the second outlet pipe hollow 122*a*, that is, the lower side of the right end in the illustrated embodiment, is formed open and communicates with the outlet opening 112.

The sensor coupling portion 130 supports a flow rate sensor (not shown) for detecting the flow rate of water flowing in the outlet flow path body hollow 111. The flow rate sensor (not shown) is supported by the sensor coupling portion 130 and may penetrate the outlet flow path body 110 to be at least partially exposed to the outlet flow path body hollow 111.

The sensor coupling portion 130 is coupled to the outlet flow path body 110. The sensor coupling portion 130 is located biased to the one side of the outlet flow path body 110 in the longitudinal direction, that is, the front side in the illustrated embodiment. The sensor coupling portion 130 is located between the first outlet pipe member 121 and the second outlet pipe member 122.

The cover portion 200 is coupled to and communicates with the outlet flow path portion 100. The cover portion 200 supports the outlet flow path portion 100. In addition, the cover portion 200 is coupled to and communicates with the tank member 400. In this case, the cover portion 200 may be coupled to the tank member 400 to seal the tank space 420. Accordingly, the water introduced into the tank space 420 may not flow out arbitrarily.

The cover portion 200 is positioned between the outlet flow path portion 100 and the tank member 400. In the illustrated embodiment, the cover portion 200 is located at the lower side of the outlet flow path portion 100, that is, at the upper side of the tank member 400.

The cover portion 200 is coupled to and communicates with the outlet buffer portion 600. The outlet buffer space 620 of the outlet buffer portion 600 is communicated with the cover space 220 of the cover portion 200, so that the cover portion 200 may partially constitute an outlet flow path of water together with the outlet buffer portion 600.

Figure 6:
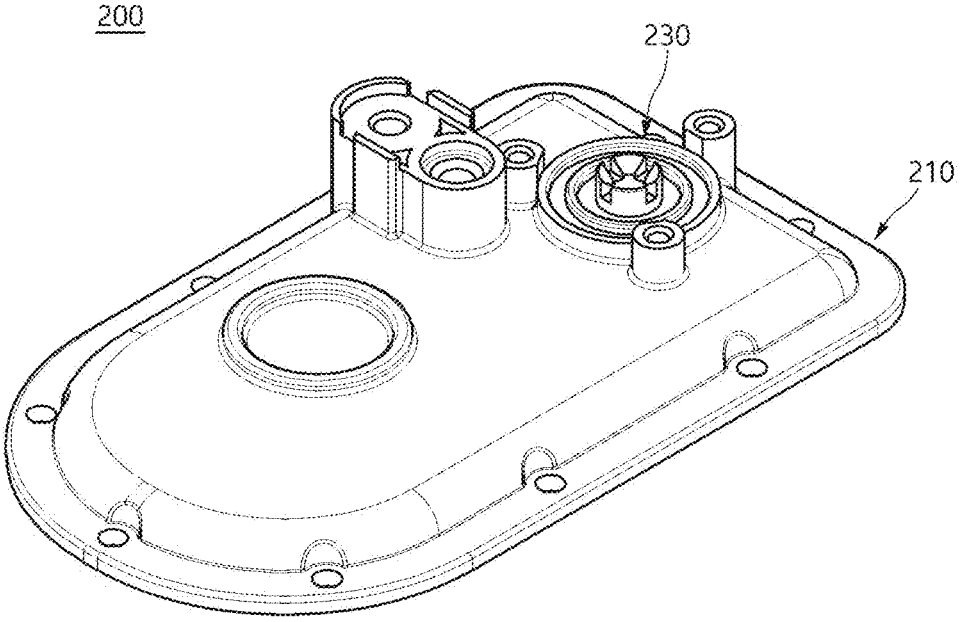
FIG. 6 is a perspective view illustrating a cover portion provided in the tank assembly of FIG. 2.
Figure 7:
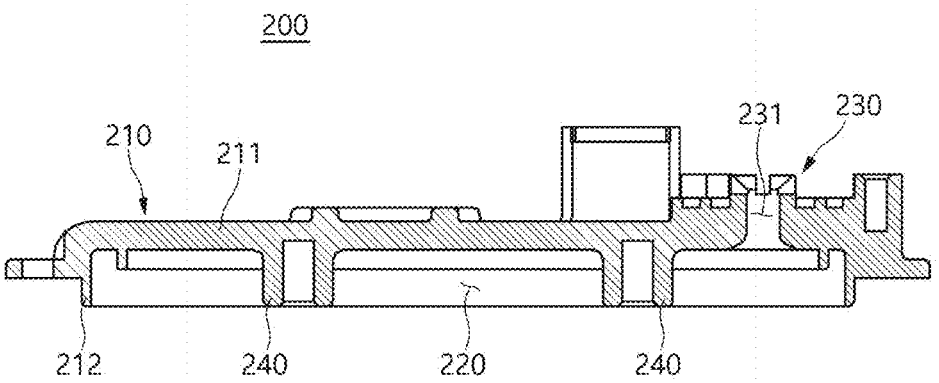
FIG. 7 is a side cross-sectional view illustrating the cover portion of FIG. 6.

In the embodiment illustrated in FIGS. 3, 6 and 7, the cover portion 200 includes a cover body 210, a cover space 220, an outlet flow path coupling portion 230, an outlet buffer coupling portion 240, and a sealing member 250.

The cover body 210 constitutes the outer shape of the cover portion 200. The cover body 210 is coupled to the outlet flow path portion 100 to support it. The cover body 210 may be coupled to the tank body 410 to seal the tank space 420.

The cover body 210 partially surrounds the cover space 220. In the illustrated embodiment, the cover body 210 surrounds the cover space 220 from one side in the height direction, that is, from an upper side in the illustrated embodiment.

The outlet flow path coupling portion 230 is formed in the cover body 210. The outlet flow path coupling portion 230 is located biased to one side of the cover body 210 in the longitudinal direction, that is, to the rear side in the illustrated embodiment.

The cover body 210 is coupled to the outlet buffer coupling portion 240. The outlet buffer coupling portion 240 is formed on the other side of the cover body 210 in the height direction, that is, on the lower side in the illustrated embodiment.

The sealing member 250 is disposed on the lower side of the cover body 210 in the height direction. The sealing member 250 may seal between the cover body 210 and the tank body 410 to block any communication between the tank space 420 and the outside.

The cover body 210 may have a shape corresponding to the shape of the outlet flow path portion 100 or the tank body 410. In the illustrated embodiment, the cover body 210 is formed in a plate shape having a length in the front and rear directions longer than the width in the left and right directions, a cross-section formed to be rounded so that one side in the longitudinal direction, that is, the front side is convex to the outside, and a height in the vertical direction. In the illustrated embodiment, the cover body 210 includes a cover top surface 211 and a cover side surface 212.

The cover top surface 211 constitutes one surface of the cover body 210. The cover top surface 211 constitutes one side of the cover body 210 in the height direction, that is, an upper surface in the illustrated embodiment. The cover top surface 211 supports the outlet flow path portion 100 coupled to the cover portion 200.

The cover side surface 212 constitutes the other surface of the cover body 210. The cover side surface 212 is located on the other side of the cover body 210 in the height direction, that is, on the lower side in the illustrated embodiment. The cover side surface 212 protrudes downward from the lower surface of the cover body 210. The cover side surface 212 extends radially inside the outer circumference of the cover body 210 along the outer circumference of the cover body 210.

The cover side surface 212 partially surrounds the cover space 220.

The cover space 220 is a space formed inside the cover body 210. The cover space 220 may be defined by being surrounded by the cover top surface 211 and the cover side surface 212. In the illustrated embodiment, the upper side of the cover space 220 is surrounded by the cover top surface 211 and the horizontal direction of the cover space 220 is surrounded by the cover side surface 212. One side of the cover space 220 in the height direction, that is, the lower side in the illustrated embodiment are open.

The cover space 220 communicates with the tank space 420. The heated water flowing in the tank space 420 may enter the cover space 220. The cover space 220 communicates with the outlet flow path coupling portion 230. The water introduced into the cover space 220 may flow to the outlet flow path portion 100 through the outlet flow path coupling portion 230.

The cover space 220 communicates with the outlet buffer space 620 of the outlet buffer portion 600. The one side, that is, the lower side, of the cover space 220 may be covered by the outlet buffer body 610. As will be described later, the outlet buffer portion 600 is spaced apart from the cover top surface 211 in the height direction and is coupled to the cover 200, and accordingly, the cover space 220 and the outlet buffer space 620 may communicate with each other.

The cover space 220 may have a shape corresponding to the shape of the cover body 210. In the illustrated embodiment, the cover space 220 is formed in a plate-shaped space having a length in the front and rear directions longer than the width in the left and right directions, a cross-section formed to be rounded so that one side in the longitudinal direction, that is, the front side is convex to the outside, and a height in the vertical direction.

The outlet flow path coupling portion 230 is a configuration in which the cover portion 200 is coupled to the outlet flow path portion 100. The outlet flow path coupling portion 230 is coupled to and communicates with the outlet flow path body 110. In addition, the outlet flow path coupling portion 230 communicates with the cover space 220 to 212 constitute a part of the flow path through which the water heated in the tank space 420 flows.

The outlet flow path coupling portion 230 is formed on one surface of the cover body 210 in the height direction, that is, the cover top surface 211. The outlet flow path coupling portion 230 may be an arbitrary shape that may be coupled to and communicate with the outlet flow path body 110. In the illustrated embodiment, the outlet flow path coupling portion 230 has a circular cross-section and is formed to have a height in the vertical direction.

In the illustrated embodiment, the outlet flow path coupling portion 230 includes a cover outlet hollow 231.

The cover outlet hollow 231 is formed through the inside of the outlet flow path coupling portion 230. The cover outlet hollow 231 extends in the height direction of the cover portion 200, that is, in the vertical direction in the illustrated embodiment. One side of the cover outlet hollow 231 in the height direction, that is, the upper side in the illustrated embodiment, is formed open to communicate with the outlet opening 112. The other side of the cover outlet hollow 231 in the height direction, that is, the lower side in the illustrated embodiment, is formed open to communicate with the cover space 220.

The cover outlet hollow 231 may be an arbitrary shape that may communicate with the outlet opening 112 and the cover space 220, respectively. In the illustrated embodiment, the cover outlet hollow 231 is formed as a cylindrical space with a circular cross-section and a height in the vertical direction.

Meanwhile, the position of the outlet flow path coupling portion 230 may be changed to correspond to the arrangement method of the outlet buffer communication hole 630 formed in the outlet buffer portion 600. That is, the position of the outlet flow path coupling portion 230 may be biased to one side where the sum of the cross-sectional areas of the plurality of outlet buffer communication holes 630 is smaller along the longitudinal direction of the tank assembly 10. In other words, the sum of the cross-sectional areas of the plurality of outlet buffer communication holes 630 may be reduced as they face the outlet flow path coupling portion 230 in the longitudinal direction.

Therefore, a relatively large amount of water among the water heated while passing through the tank space 420 may flow into the outlet buffer space 620 at a position further away from the outlet flow path coupling portion 230, and may flow a longer distance toward the outlet flow path coupling portion 230. Likewise, the flow rate of water introduced into the outlet buffer space 620 at a position closer to the outlet flow path coupling portion 230 may be formed to be relatively smaller.

The length of the flow path flowing before the water flowing out of the tank space 420 is discharged increases, so that the heated water may be sufficiently mixed and then discharged to the outside. In addition, the flow rate of the outflowed water is adjusted, so that the water introduced into the tank space 420 is contacted with the heater member 310 for a longer time and may be sufficiently heated and then be discharged from the tank space 420.

The outlet buffer coupling portion 240 is a configuration in which the cover portion 200 is coupled to the outlet buffer portion 600. The outlet buffer coupling portion 240 is located on the other side of the cover body 210 in the height direction, that is, on the lower side in the illustrated embodiment. The outlet buffer coupling portion 240 is located in the cover space 220.

The outlet buffer coupling portion 240 is formed to extend from the lower side of the cover body 210 toward the tank member 400 or the outlet buffer portion 600, that is, extend downward in the embodiment shown. A cover coupling portion 640 provided in the outlet buffer portion 600 is coupled to the outlet buffer coupling portion 240. In an embodiment, the outlet buffer coupling portion 240 and the cover coupling portion 640 may be fitted to each other.

The outlet buffer coupling portion 240 may be an arbitrary shape that may be coupled to the cover coupling portion 640. In the illustrated embodiment, the outlet buffer coupling portion 240 has a cylindrical shape with a circular cross-section and a height in the vertical direction. In the above embodiment, when water flows in the cover space 220, the resistance applied by the outlet buffer coupling portion 240 is minimized, so that water may flow smoothly.

The outlet buffer coupling portion 240 may be provided in plural. The plurality of outlet buffer coupling portions 240 may be spaced apart from each other and may be respectively coupled to the plurality of cover coupling portions 640. In the illustrated embodiment, the outlet buffer coupling portion 240 may be provided in a pair and spaced apart from the cover body 210 in the longitudinal direction, that is, the front and rear directions. The pair of outlet buffer coupling portions 240 are coupled to a pair of cover coupling portions 640, respectively.

The shape, number, and arrangement of the outlet buffer coupling portion 240 may be changed according to the shape, number, and arrangement of the cover coupling portion 640.

The sealing member 250 is disposed at a position where the cover portion 200 and the tank member 400 are coupled to each other, and the cover space 220 and the tank space 420 are configured to communicate with each other but to be sealed from the outside.

The sealing member 250 may be formed of a material having a predetermined elasticity. The cover portion 200 and the tank member 400 may be compressed and coupled by the sealing member 250. In an embodiment, the sealing member 250 may be formed of a rubber or silicon material.

The sealing member 250 may have a shape corresponding to the shape of the cover body 210 or the tank body 410. In the illustrated embodiment, the sealing member 250 has a length in the front and rear directions longer than the width in the left and right directions, a cross-section formed to be rounded so that one side in the longitudinal direction, that is, the front side is convex to the outside.

The heater portion 300 substantially serves to heat the water introduced into the tank space 420. The heater portion 300 is electrically connected to a controller (not shown) provided in the bidet 1 and may receive power or control signals required for operation.

The heater portion 300 is coupled to the tank member 400. Some components of the heater portion 300 may be located in the tank space 420, and other components of the heater portion 300 may be located outside the tank member 400. In the illustrated embodiment, the heater portion 300 is coupled to one side of the tank body 410 in the longitudinal direction, that is, the rear side.

Figure 8:
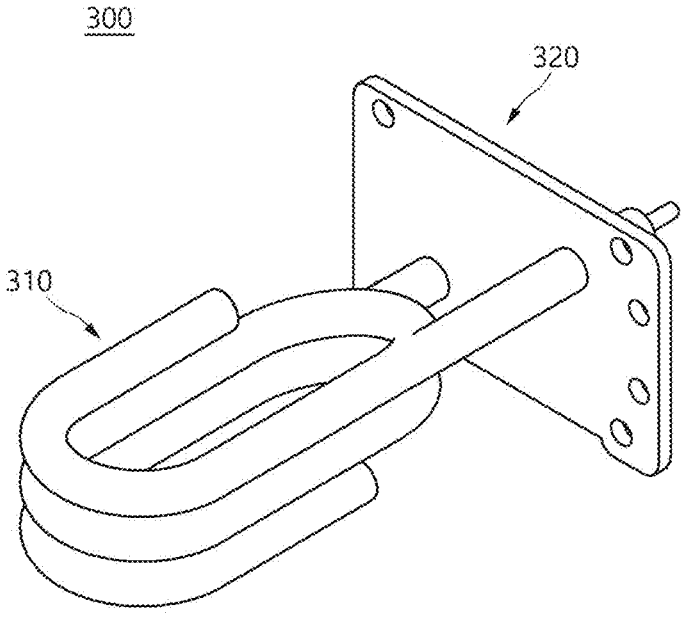
FIG. 8 is a perspective view illustrating a heater portion provided in the tank assembly of FIG. 2.

In the embodiment shown in FIG. 8, the heater portion 300 includes a heater member 310 and a heater support plate 320.

The heater member 310 heats the water introduced into the tank space 420. The heater member 310 is located in the tank space 420. The heater member 310 is electrically connected to a controller (not shown) and may receive power or control signals required for operation. The heater member 310 may be controlled to heat water at a predetermined temperature.

The heater member 310 may be provided in any form capable of heating the water accommodated in the tank space 420. In an embodiment, the heater member 310 may be provided in the form of a sheath heater.

The heater member 310 is coupled to the heater support plate 320.

The heater support plate 320 is coupled to the heater member 310 to support it. The heater support plate 320 is a part where the heater portion 300 is coupled to the tank member 400. The heater support plate 320 covers the heater insertion opening 440 formed in the tank member 400 and is coupled to the tank body 410. The heater support plate 320 closes the heater insertion opening 440 to block communication between the tank space 420 and the outside.

Although the reference numeral is not assigned, a through hole through which the heater member 310 is coupled may be formed inside the heater support plate 320.

The heater support plate 320 may have a shape corresponding to the shape of the heater insertion opening 440. In the illustrated embodiment, the heater support plate 320 is formed in a plate shape with a length in the left and right directions, a height in the vertical direction, and a thickness in the front and rear directions.

The tank member 400 receives water from the fluid supply unit 20 and transmits the received water to the outlet flow path portion 100. The tank member 400 is fluidly connected to the fluid supply unit 20 and the outlet flow path portion 100, respectively. As described above, the tank member 400 may be fluidly connected to the fluid supply unit 20 through the inlet flow path portion 11 and the inlet flow path hollow 12 formed therethrough (see FIGS. 19 and 20).

The tank member 400 is coupled to and communicates with the outlet flow path portion 100. Specifically, the tank member 400 is coupled to and communicates with the outlet flow path portion 100 via the cover portion 200. To this end, the cover portion 200 is coupled to and communicates with the outlet flow path portion 100 and the tank member 400, respectively, as described above.

The tank member 400 is coupled to and communicates with the cover portion 200. The tank space 420 formed inside the tank member 400 may be covered and sealed by the cover portion 200. The tank space 420 formed inside the tank member 400 communicates with the cover space 220 formed inside the cover portion 200. The water heated in the tank space 420 may flow out to the cover space 220.

The tank member 400 is coupled to the heater portion 300. The heater portion 300 closes one side of the tank space 420, that is, the rear side in the illustrated embodiment, and is coupled to the tank member 400. The heater member 310 may be accommodated in the tank space 420 to heat the water introduced into the tank space 420.

The tank member 400 is coupled to and communicates with the inlet buffer portion 500. The inlet buffer portion 500 may be accommodated in the tank space 420 and may be fluidly connected to the fluid supply unit 20 through the inlet flow path portion 11. The water introduced from the fluid supply unit 20 may be introduced into the tank space 420 after passing through the inlet buffer portion 500.

The tank member 400 is coupled to and communicates with the outlet buffer portion 600. The outlet buffer portion 600 may be accommodated in the tank space 420 in a state coupled to the cover portion 200 and communicate with the tank space 420. The water heated in the tank space 420 may flow along the outlet buffer space 620 of the outlet buffer portion 600 and the cover space 220 communicating therewith to flow to the outlet flow path portion 100.

Figure 9:
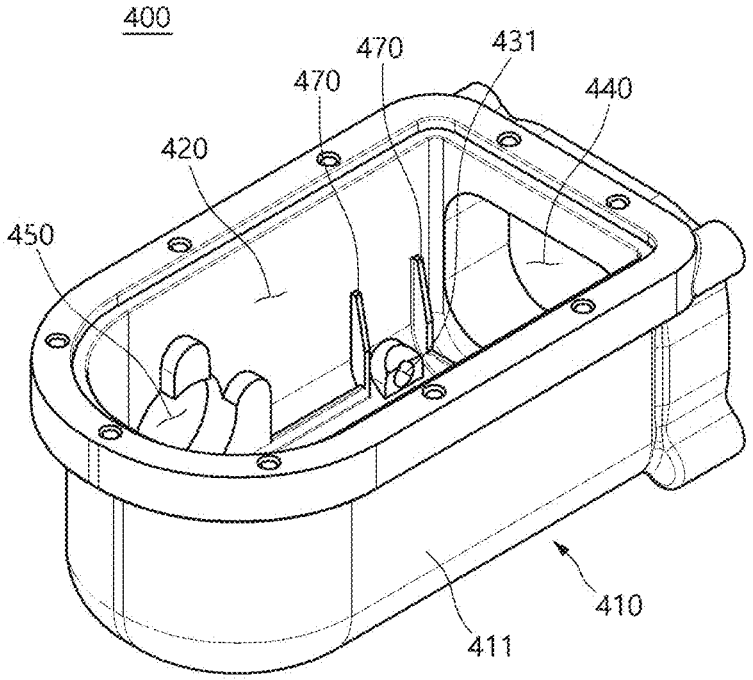
FIG. 9 is a perspective view illustrating a tank member provided in the tank assembly of FIG. 2.
Figure 10:
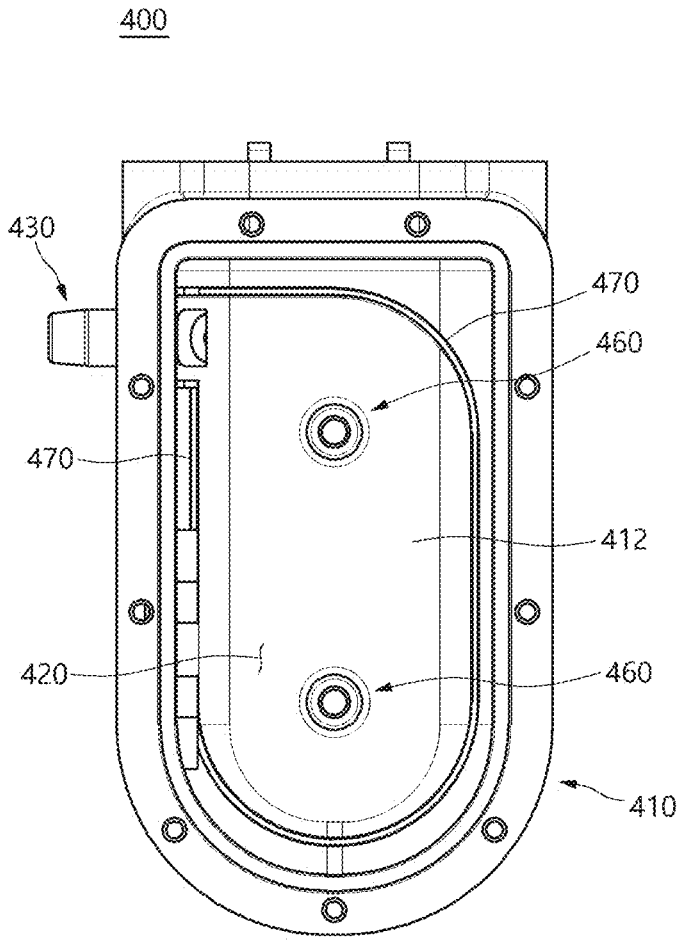
FIG. 10 is a plan view illustrating the tank member of FIG. 9.
Figure 11:
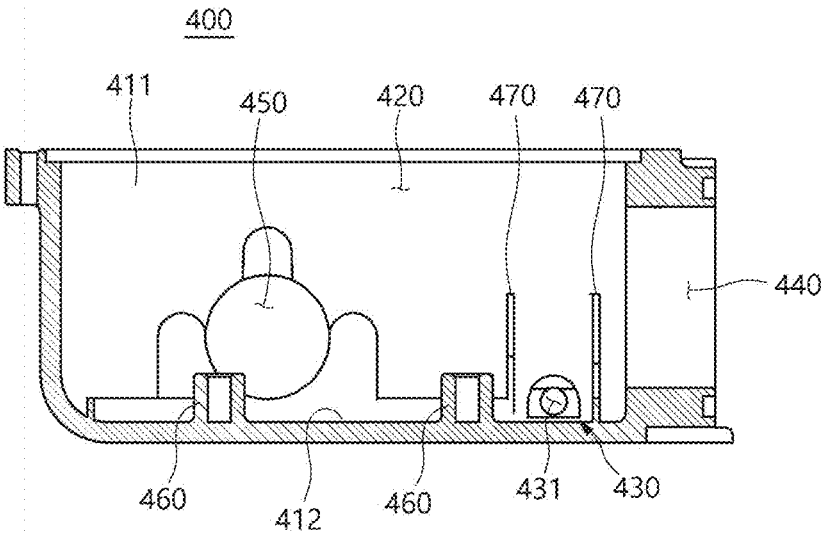
FIG. 11 is a side cross-sectional view illustrating the tank member of FIG. 9.

In the embodiment shown in FIGS. 9 to 11, the tank member 400 includes a tank body 410, a tank space 420, a tank inlet pipe member 430, a heater insertion opening 440, a drain opening 450, an inlet buffer coupling portion 460, and an inlet buffer support rib 470.

The tank body 410 constitutes the outer shape of the tank member 400. The tank body 410 is a part where the tank member 400 is coupled to another components of the tank assembly 10. In the illustrated embodiment, the tank body 410 is coupled to the inlet flow path 11, the cover portion 200, and the heater portion 300.

A tank space 420 is formed inside the tank body 410. The tank body 410 at least partially surrounds the tank space 420. In the illustrated embodiment, the tank body 410 surrounds the tank space 420 on the front side, left side, right side, and bottom side.

The tank body 410 is coupled to the cover portion 200. A through hole (reference numeral not assigned) is formed on one side of the tank body 410 in the height direction, that is, the upper outer circumference in the illustrated embodiment. The through hole (reference numeral not assigned) may be arranged to match a through hole (reference numeral not assigned) formed along the outer circumference of the cover body 210.

A fastening member (not shown), such as a screw member, may be penetratingly coupled to the through holes (reference numeral not assigned) so that the tank body 410 and the cover body 210 may be fixedly coupled.

The tank body 410 is coupled to the heater support plate 320 of the heater portion 300. The heater insertion opening 440 formed at one side of the tank body 410 in the longitudinal direction, that is, at the rear side in the illustrated embodiment, may be closed by the heater support plate 320.

The tank body 410 may be an arbitrary shape in which it is coupled to other components of the tank assembly 10 and may be coupled to other components of the tank member 400 to support them. In the illustrated embodiment, the tank body 410 is a three-dimensional shape with a length in the front and rear directions longer than the width in the left and right directions and a height in the vertical direction. At this time, one side of the tank body 410 in the longitudinal direction, that is, the front side in the illustrated embodiment, are rounded to be convex to the outside.

The shape of the tank body 410 may be changed to correspond to the shape of the cover portion 200, the inlet buffer portion 500, and the outlet buffer portion 600.

In the illustrated embodiment, the tank body 410 includes a tank side surface 411 and a tank bottom surface 412.

The tank side surface 411 constitutes one surface of the tank body 410. The tank side surface 411 at least partially surrounds the tank space 420 and is coupled to the inlet flow path portion 11. In the illustrated embodiment, the tank side surface 411 constitutes each side of the tank body 410 in the horizontal direction, that is, the front side surface, the left side surface and the right side surface. The tank side surface 411 surrounds in a part of the tank space 420 in a horizontal direction, that is, in the front, left and right side surfaces in the illustrated embodiment.

Any one of the tank side surfaces 411 may be coupled to the inlet flow path 11. In the illustrated embodiment, the tank side surface 411 located at the left side is coupled to the inlet flow path portion 11. A through hole may be formed on the tank side surface 411 located at the left side to communicate with the inlet flow path portion 11 and the tank space 420. In addition, a tank inlet pipe member 430 coupled to and communicating with the inlet flow path portion 11 may be coupled to the tank side surface 411 located at the left side.

The tank side surface 411 is continuous with the tank bottom surface 412.

The tank bottom surface 412 constitutes the other surface of the tank body 410. Tank bottom surface 412 at least partially surrounds tank space 420. In the illustrated embodiment, the tank bottom surface 412 constitutes the lower inner surface of the tank body 410 and surrounds the tank space 420 from the lower side.

An inlet buffer coupling portion 460 is disposed on the bottom surface 412 of the tank. The inlet buffer portion 500 coupled to the inlet buffer coupling portion 460 may be positioned such that the inlet buffer body 510 is spaced apart from the tank bottom surface 412. Accordingly, a space in which the introduced water may flow may be secured.

The tank space 420 is a space formed inside the tank body 410. The tank space 420 is defined by being at least partially surrounded by the tank body 410. In the illustrated embodiment, the tank space 420 is surrounded on the front side, left side, right side, and lover side by the tank side surface 411 and the tank bottom surface 412.

The tank space 420 communicates with the outside. Specifically, the tank space 420 is fluidly connected to the fluid supply unit 20 through the inlet flow path hollow 12 formed inside the inlet flow path portion 11. In addition, the tank space 420 is fluidly connected to the outlet flow path portion 100 through the cover space 220 and the outlet buffer space 620. The tank space 420 may receive water from the outside and transmit the received water to the outside.

The tank space 420 may be covered by the cover portion 200. One side of the tank space 420 in the height direction, that is, the upper side in the illustrated embodiment, are formed open, and the one side may be covered and closed by the cover portion 200.

The tank space 420 at least partially accommodates the heater portion 300. Specifically, the heater member 310 is accommodated in the tank space 420. The heater member 310 may heat the water introduced into the tank space 420.

The tank space 420 may be surrounded by the heater portion 300. The heater support plate 320 may be coupled to the heater insertion opening 440 formed on one side of the tank space 420 in the longitudinal direction, that is, on the rear side in the illustrated embodiment, to surround the tank space 420.

The tank space 420 accommodates the inlet buffer portion 500. The tank space 420 may communicate with the inlet flow path hollow 12 through the inlet buffer space 520. Therefore, the water introduced along the inlet flow path hollow 12 may be introduced into the tank space 420 after passing through the inlet buffer space 520. Accordingly, the flow rate and speed of water introduced into the tank space 420 are adjusted to increase the length of the inlet flow path, and as a result, the contact time with the heater member 310 may be sufficiently secured.

The tank space 420 accommodates the outlet buffer portion 600. The tank space 420 may communicate with the outlet flow path portion 100 through the outlet buffer space 620 and the cover space 220 communicating therewith. Therefore, the water heated in the tank space 420 may flow through the outlet buffer space 620 and the cover space 220 communicating therewith and then flow to the outlet flow path portion 100.

Accordingly, the flow rate and speed of water flowing out of the tank space 420 may also be adjusted to increase the length of the outlet flow path. As a result, the time for which water stays in the tank space 420 and is heated by the heater member 310 increases, and the heating effect of water may be improved. In addition, since the water passes through the plurality of outlet buffer communication holes 630 and mixes and then flows, the temperature of the water flowing out may be uniform.

A detailed description of the above-mentioned water flow process will be given later.

The tank inlet pipe member 430 is a part where the tank member 400 is coupled to the inlet flow path 11. The tank inlet pipe member 430 may extend to the outside of the tank body 410 and be fluidly coupled to the inlet flow path portion 11. In the illustrated embodiment, the tank inlet pipe member 430 is located at the left rear side of a part of the tank side surface 411. The tank inlet pipe member 430 extends in the width direction of the tank body 410, that is, toward the left in the embodiment shown.

The tank inlet hollow 431 is formed through the inside of the tank inlet pipe member 430.

The tank inlet hollow 431 communicates the inlet flow path hollow 12 with the inlet buffer space 520. As will be described later, it may be said that the tank space 420 communicates with the inlet buffer space 520, so the tank inlet hollow 431 communicates the tank space 420 with the inlet flow path hollow 12.

The tank inlet hollow 431 extends in the extending direction of the tank inlet pipe member 430, that is, in the left and right directions in the illustrated embodiment. Each end of the tank inlet hollow 431 in the extending direction, that is, the left and right ends in the illustrated embodiment, are each formed open. One end of the tank inlet hollow 431 in the extending extension, that is, the left end in the illustrated embodiment, communicate with the inlet flow path hollow 12. The other end of the tank inlet hollow 431 in the extending direction, that is, the right end in the illustrated embodiment, communicate with the inlet buffer space 520.

The heater insertion opening 440 communicates the tank space 420 with the outside to provide a passage through which the heater member 310 is accommodated in the tank space 420. The heater insertion opening 440 is formed through one side of the tank body 410 in the longitudinal direction, that is, the rear side in the illustrated embodiment.

The heater member 310 is penetrated through the heater insertion opening 440. In addition, the heater insertion opening 440 may be closed by the heater support plate 320.

The heater insertion opening 440 may have a shape corresponding to the shape of the heater support plate 320. In the illustrated embodiment, the heater insertion opening 440 is formed as a three-dimensional space with a height in the front and rear directions.

The drain opening 450 communicates the tank space 420 with the outside. The water flowing in the tank space 420 may flow out to the outside when the drain opening 450 is open. In other words, the drain opening 450 may be open when it is desired to empty the tank space 420.

The drain opening 450 is formed through any one of the tank side surfaces 411. In the illustrated embodiment, the drain opening 450 is formed through the tank side surface 411 located at the left side.

The drain opening 450 is coupled to the inlet flow path portion 11. A part of the inlet flow path portion 11 may be inserted and closed in the drain opening 450.

The inlet buffer coupling portion 460 is coupled to the inlet buffer portion 500 to support it. The fluctuation of the inlet buffer portion 500 may be prevented by the inlet buffer coupling portion 460. Accordingly, the inlet buffer space 520 is secured, and the introduced water may be introduced into the tank space 420 through the inlet buffer space 520.

The inlet buffer coupling portion 460 is located in the tank space 420. The inlet buffer coupling portion 460 protrudes from the tank bottom 412 to one side of the tank member 400 in the height direction, that is, upward in the illustrated embodiment. It is preferable that the inlet buffer coupling portion 460 protrudes by a length that allows the lower end of the inlet buffer body 510 to be seated on the tank bottom surface 412.

The inlet buffer coupling portion 460 is coupled to the tank coupling portion 540 of the inlet buffer portion 500. Specifically, the inlet buffer coupling portion 460 may be at least partially accommodated in the tank coupling portion 540.

The inlet buffer coupling portion 460 may have a shape corresponding to the shape of the tank coupling portion 540. In the illustrated embodiment, the inlet buffer coupling portion 460 has a cylindrical shape with a circular cross-section and a height in the vertical direction.

The inlet buffer coupling portion 460 may be provided in plural. The plurality of inlet buffer coupling portions 460 may be spaced apart from each other and may be coupled to the plurality of tank coupling portions 540, respectively. In the illustrated embodiment, the inlet buffer coupling portion 460 is provided in a pair and spaced apart from each other in the longitudinal direction, that is, in the front and rear directions, of the tank body 410.

The inlet buffer support rib 470 supports the inlet buffer portion 500. Accordingly, the inlet buffer portion 500 may be accommodated in the tank space 420 to be spaced apart from the bottom surface 412 of the tank. Accordingly, the inlet buffer space 520 is secured, and the introduced water may be introduced into the tank space 420 through the inlet buffer space 520.

The inlet buffer support rib 470 is formed to protrude from the inner surface of the tank body 410 surrounding the tank space 420. The inlet buffer support rib 470 may extend along the inner surface of the tank body 410. The inlet buffer support rib 470 may be an arbitrary shape capable of supporting the inlet buffer portion 500.

The inlet buffer support ribs 470 may be provided in plural. The plurality of inlet buffer support ribs 470 may be spaced apart from each other to support the inlet buffer portion 500 at different positions. In the embodiment shown, the inlet buffer support ribs 470 are provided in a pair.

In the illustrated embodiment, a part of one of inlet buffer support rib 470 is formed on the left inner surface of the tank body 410. The part extends in a vertical direction. In addition, another part of one of the inlet buffer support rib 470 is formed on the tank bottom surface 412 of the tank body 410. The another part extend in the left and right directions and in the front and rear directions, and the part of which the extending direction is changed are rounded to be convex to the outside.

In addition, a part of the other inlet buffer support rib 470 is located on the left inner surface of the tank body 410, that is, on the front side compared to the part of the one inlet buffer support rib 470. In addition, another part of the other inlet buffer support rib 470 is formed to extend in the front and rear directions on the tank bottom surface 412.

The inlet buffer portion 500 is configured to extend the flow path of water introduced into the tank space 420. The water introduced from the fluid supply unit 20 may be introduced into the tank space 420 after passing through the inlet buffer portion 500. Accordingly, the flow rate and speed of the introduced water are adjusted to ensure a sufficient contact time between the water introduced into the tank space 420 and the heater member 310, and as a result, the water may be sufficiently heated.

The inlet buffer portion 500 is coupled to the tank member 400. Specifically, the inlet buffer portion 500 is accommodated in the tank space 420 and is seated on the tank bottom surface 412 and the inlet buffer support rib 470. The inlet buffer portion 500 is coupled to the inlet buffer coupling portion 460 to prevent arbitrary movement.

The inlet buffer portion 500 is fluidly connected to the inlet flow path portion 11. Specifically, the inlet buffer portion 500 communicates with the inlet flow path hollow 12 through the tank inlet pipe member 430. The inlet buffer portion 500 communicates with the tank inlet hollow 431.

The inlet buffer portion 500 communicates with the tank space 420. The water introduced into the inlet buffer portion 500 may flow out to the tank space 420. At this time, the inlet buffer portion 500 is formed to change the size of the cross-sectional area of the component (that is, the inlet buffer communication hole 550 to be described later) communicating with the tank space 420 according to the distance from the tank inlet hollow 431. Specifically, the flow rate of water that flows out of the inlet buffer portion 500 into the tank space 420 may be proportional to the distance to the tank inlet hollow 431.

Accordingly, the flow rate of water introduced into the tank space 420 at a part far from the tank inlet hollow 431 may be greater than the flow rate of water introduced into the tank space 420 at a part close to the tank inlet hollow 431. Therefore, the flow path of water introduced into the tank space 420 may extend.

Figure 12:
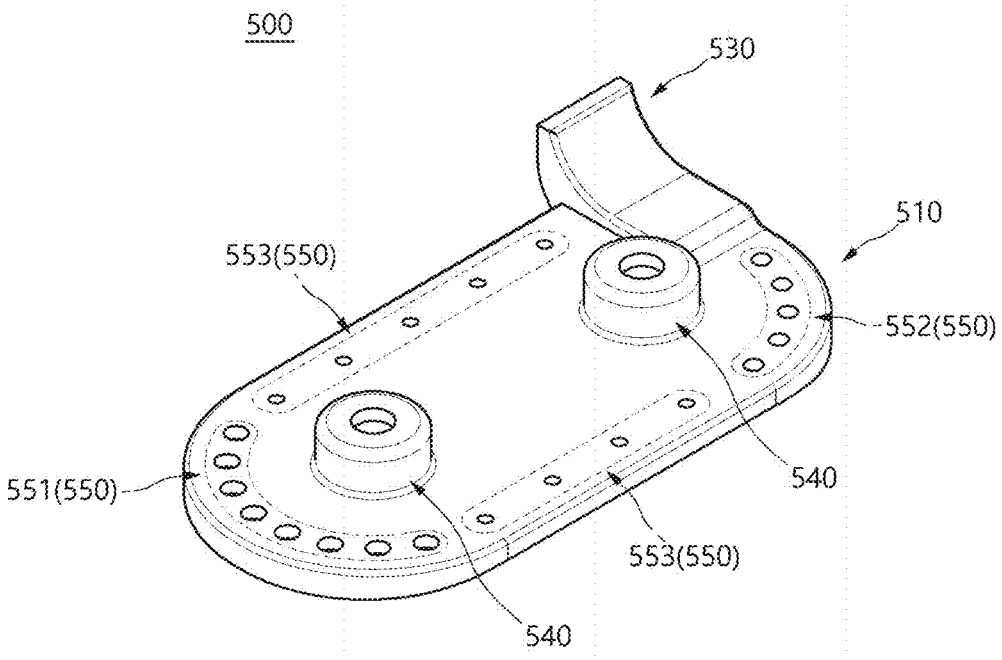
FIG. 12 is a perspective view illustrating an inlet buffer portion provided in the tank assembly of FIG. 2.
Figure 13:
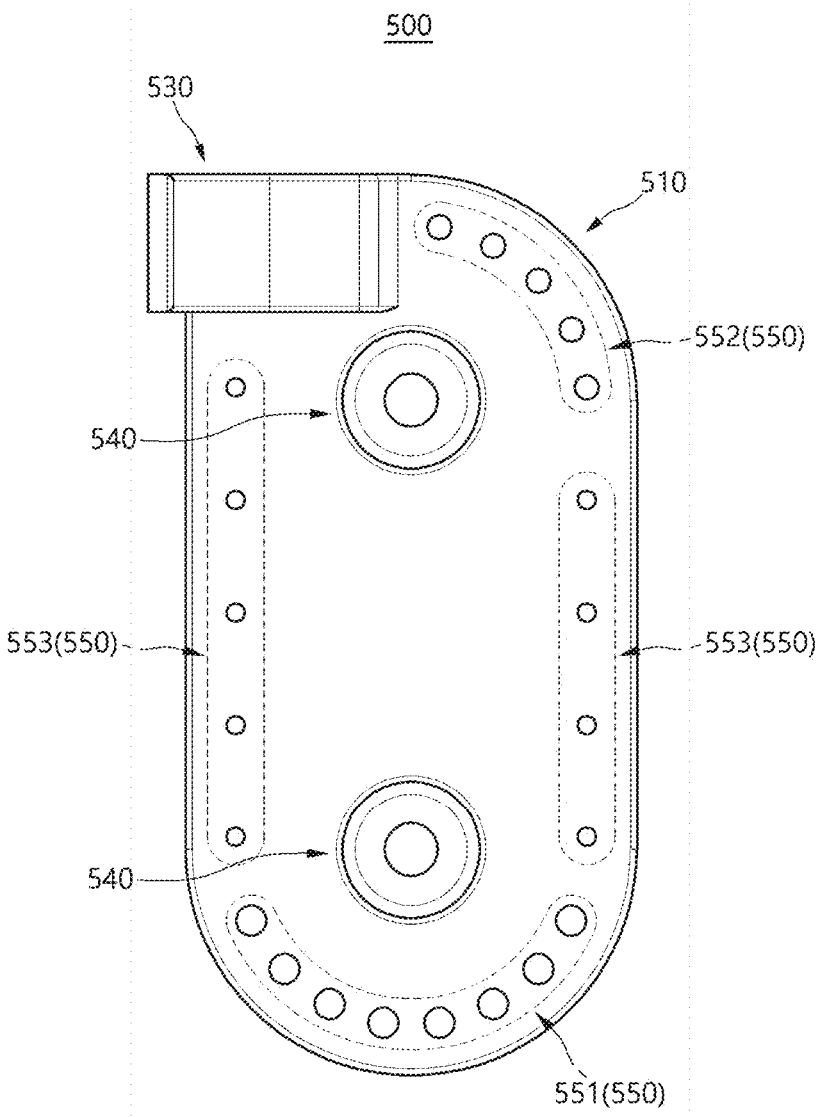
FIG. 13 is a plan view illustrating the inlet buffer portion of FIG. 12.
Figure 14:
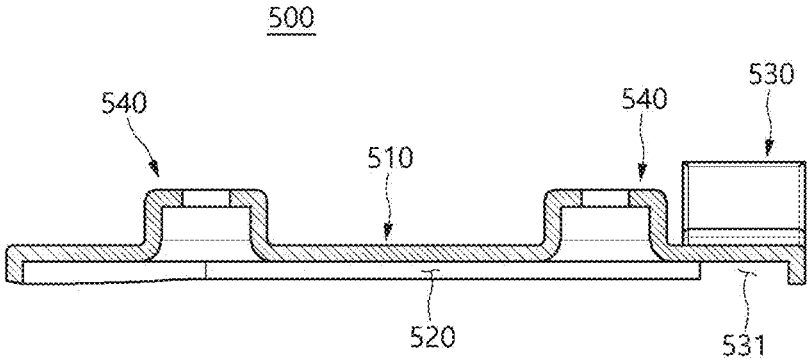
FIG. 14 is a side cross-sectional view illustrating the inlet buffer portion of FIG. 12.

In the embodiment illustrated in FIGS. 12 to 14, the inlet buffer portion 500 includes an inlet buffer body 510, an inlet buffer space 520, a tank inlet coupling portion 530, a tank coupling portion 540, and an inlet buffer communication hole 550.

The inlet buffer body 510 constitutes the body of the inlet buffer portion 500. Another configuration of the inlet buffer portion 500 is formed in the inlet buffer body 510. In the illustrated embodiment, the inlet buffer body 510 is provided with the inlet buffer space 520, the tank inlet coupling portion 530, the tank coupling portion 540, and the inlet buffer communication hole 550.

The inlet buffer body 510 may have a shape corresponding to the shape of the tank space 420. In the illustrated embodiment, the inlet buffer body 510 is provided in a plate shape with a length in the front and rear directions longer than a width in the left and right directions and a thickness in the vertical direction. In this case, each end of the inlet buffer body 510 in the longitudinal direction, that is, the front side end and the rear side end in the illustrated embodiment are rounded to be convex to the outside.

In an embodiment, the inlet buffer body 510 may be formed in the same cross-section as the cross-section of the tank space 420. In the above embodiment, the inlet buffer body 510 may partition the tank space 420 in the height direction, that is, in the vertical direction. Each partitioned space may communicate only through the inlet buffer communication hole 550.

A part of the lower side of the inlet buffer body 510 is seated on the inlet buffer support rib 470. At this time, the lower end of the outer circumference of the inlet buffer body 510 is seated on the tank bottom surface 412. Accordingly, direct communication between the inlet buffer space 520 and the tank space 420 may be blocked.

The inlet buffer space 520 is a space formed inside the inlet buffer body 510. The inlet buffer space 520 is defined by being at least partially surrounded by the inlet buffer body 510. In the illustrated embodiment, the inlet buffer space 520 is surrounded by the inlet buffer body 510 on one side in the height direction, that is, the upper side and the radially outer side.

The other side of the inlet buffer space 520 in the height direction, that is, the lower side in the illustrated embodiment are open. The lower side may be closed by the tank bottom surface 412. Therefore, the upper side and the radially outer side of the inlet buffer space 520 may be closed by the inlet buffer body 510, and the lower side may be closed by the tank bottom surface 412.

The inlet buffer space 520 communicates with the tank inlet hollow 431. Specifically, the inlet buffer space 520 may communicate with the tank inlet hollow 431 by the inlet buffer hollow 531 formed inside the tank inlet coupling portion 530. The inlet buffer space 520 communicates with the inlet buffer hollow 531. Accordingly, an inlet flow path of water may be formed.

The inlet buffer space 520 communicates with the tank space 420. Specifically, the inlet buffer space 520 communicates with the tank space 420 by the inlet buffer communication hole 550. Accordingly, an outlet flow path of water may be formed.

As described above, the inlet buffer space 520 is closed by the inlet buffer body 510 and the tank bottom surface 412. Therefore, it will be understood that the communication between the inlet buffer space 520 and the other components is achieved only by the inlet buffer hollow 531 and the inlet buffer communication hole 550.

The tank inlet coupling portion 530 is a part in which the inlet buffer portion 500 is fluidly connected to the inlet flow path portion 11. The tank inlet coupling portion 530 may communicate with the inlet flow path hollow 12 through the tank inlet hollow 431. The tank inlet coupling portion 530 communicates with the tank inlet hollow 431.

The tank inlet coupling portion 530 may be disposed at a position corresponding to the position of the tank inlet pipe member 430. In the illustrated embodiment, the tank inlet coupling portion 530 is located on one side of the inlet buffer body 510 in the longitudinal direction, that is, on the rear left side.

The tank inlet coupling portion 530 may be disposed to completely surround the tank inlet hollow 431. That is, the tank inlet coupling portion 530 may block direct communication between the tank inlet hollow 431 and the tank space 420. Therefore, the tank inlet hollow 431 may communicate with the tank space 420 only through the inlet buffer space 520.

In the illustrated embodiment, the tank inlet coupling portion 530 includes an inlet buffer hollow 531.

The inlet buffer hollow 531 is a space formed inside the tank inlet coupling portion 530. The inlet buffer hollow 531 communicates the inlet buffer space 520 with the tank inlet hollow 431. The inlet buffer hollow 531 may be defined by being surrounded the inner surface of the tank inlet coupling portion 530.

One side of the inlet buffer hollow 531 in the width direction, that is, the left side in the illustrated embodiment, are formed open and communicate with the tank inlet hollow 431. The other side of the inlet buffer hollow 531 in the width direction, that is, the right side in the illustrated embodiment, are formed open and communicate with the inlet buffer space 520.

The inlet buffer hollow 531 may have a shape corresponding to the shape of the tank inlet coupling portion 530. At this time, the inlet buffer hollow 531 may be formed so that its cross-sectional area decreases as it moves away from the downstream side of the water inlet direction, that is, the tank inlet hollow 431. Accordingly, water may be easily introduced at the tank inlet hollow 431, but the flow rate may increase along the inlet buffer space 520.

The tank coupling portion 540 is a part where the inlet buffer portion 500 is coupled to the tank member 400. The tank coupling portion 540 at least partially receives the inlet buffer coupling portion 460. The tank coupling portion 540 prevents arbitrary movement of the inlet buffer portion 500, and may block direct communication between the inlet buffer space 520 and the tank space 420.

The tank coupling portion 540 is formed on the inlet buffer body 510. One side of the tank coupling portion 540 in the height direction, that is, the upper side in the illustrated embodiment, protrude upward. The other side of the tank coupling portion 540 in the height direction, that is, the lower side in the illustrated embodiment are recessed. Accordingly, a space for accommodating the inlet buffer coupling portion 460 is formed inside the tank coupling portion 540.

The tank coupling portion 540 may have a shape corresponding to the shape of the inlet buffer coupling portion 460. In the illustrated embodiment, the tank coupling portion 540 has cylindrical shape with a circular cross-section and a height in the vertical height, and a cylindrical space is formed inside it.

The tank coupling portion 540 may be provided in plural. The plurality of tank coupling portions 540 may be spaced apart from each other and may be coupled to the plurality of inlet buffer coupling portions 460, respectively. In the illustrated embodiment, the tank coupling portion 540 is provided in a pair and spaced apart from each other in the longitudinal direction of the inlet buffer body 510, that is, the front and rear directions.

The number and arrangement method of the tank coupling portion 540 may be changed according to the number and arrangement method of the inlet buffer coupling portion 460.

The inlet buffer communication hole 550 communicates the inlet buffer space 520 with the tank space 420. The water introduced into the inlet buffer space 520 may only flow out into the tank space 420 through the inlet buffer communication hole 550.

The inlet buffer communication hole 550 is formed inside the inlet buffer body 510. In the illustrated embodiment, the inlet buffer communication hole 550 is disposed adjacent to the outer circumference of the inlet buffer body 510. The inlet buffer communication hole 550 is formed in the thickness direction of the inlet buffer body 510, that is, in the vertical direction in the illustrated embodiment.

The inlet buffer communication hole 550 may be an arbitrary shape capable of communicating the inlet buffer space 520 with the tank space 420. In the illustrated embodiment, the inlet buffer communication hole 550 has a cylindrical space with a circular cross-section and a height in the vertical direction.

The inlet buffer communication hole 550 may be formed in plural. The plurality of inlet buffer communication holes 550 may be spaced apart and communicate the inlet buffer space 520 with the tank space 420 at different locations.

In this case, each inlet buffer communication hole 550 may have a different cross-sectional area according to a distance to the tank inlet coupling portion 530. Accordingly, the flow rate of water flowing from the inlet buffer space 520 to the tank space 420 may be different depending on the distance to the tank inlet coupling portion 530.

In the illustrated embodiment, the inlet buffer communication hole 550 includes a first inlet buffer communication hole 551, a second inlet buffer communication hole 552, and a third inlet buffer communication hole 553.

The first inlet buffer communication hole 551 is positioned farthest from the tank inlet coupling portion 530. In other words, the first inlet buffer communication hole 551 is located on the other side of the inlet buffer body 510 in the longitudinal direction, that is, on the front side in the illustrated embodiment, so as to be opposite to the tank inlet coupling portion 530 located on the rear side of the illustrated embodiment.

The first inlet buffer communication hole 551 is disposed to face the tank inlet coupling portion 530 with the pair of tank coupling portions 540 and the third inlet buffer communication hole 553 interposed therebetween along the longitudinal direction of the inlet buffer body 510.

The first inlet buffer communication hole 551 may be provided in plural. The plurality of first inlet buffer communication holes 551 may be spaced apart from each other along the outer circumference of the inlet buffer body 510. In the illustrated embodiment, a total of eight first inlet buffer communication holes 551 are formed, and are spaced apart from each other along the outer circumference of the front side of the inlet buffer body 510, that is, the outer circumference formed to be rounded.

The second inlet buffer communication hole 552 is located closest to the tank inlet coupling portion 530. In other words, the second inlet buffer communication hole 552 is located on the one side of the inlet buffer body 510 in the longitudinal direction, that is, adjacent the tank inlet coupling portion 530 located on the rear side of the illustrated embodiment.

The second inlet buffer communication hole 552 is disposed to face the first inlet buffer communication hole 551 with the pair of tank coupling portions 540 and the third inlet buffer communication hole 533 interposed therebetween along the longitudinal direction of the inlet buffer body 510.

The second inlet buffer communication hole 552 may be provided in plural. The plurality of second inlet buffer communication holes 552 may be disposed to be spaced apart from each other along the outer circumference of the inlet buffer body 510. In the illustrated embodiment, a total of five second inlet buffer communication holes 552 are formed, and are spaced apart from each other along the right outer circumference of the rear of the inlet buffer body 510, that is, the outer circumference formed to be rounded.

The third inlet buffer communication hole 553 is located between the first and second inlet buffer communication holes 551 and 552. In other words, the third inlet buffer communication hole 553 is located between the one side and the other side of the inlet buffer body 510 in the longitudinal direction.

The third inlet buffer communication hole 553 is positioned between the first and second inlet buffer communication holes 551 and 552 along the length longitudinal direction of the inlet buffer body 510.

The third inlet buffer communication hole 553 may be provided in plural. The plurality of third inlet buffer communication holes 553 may be spaced apart from each other along the outer circumference of the inlet buffer body 510. In the illustrated embodiment, a total of nine inlet buffer communication holes 553 are provided. The five third inlet buffer communication holes 553 are disposed to be spaced apart from each other along the left outer circumference of the inlet buffer body 510. The four third inlet buffer communication holes 553 are disposed to be spaced apart from each other along the right outer circumference of the inlet buffer body 510.

At this time, the cross-sectional area of the first inlet buffer communication hole 551 may be larger than the cross-sectional areas of the second and third inlet buffer communication holes 552 and 553. In addition, the sum of cross-sectional areas of the plurality of first inlet buffer communication holes 551 may be greater than the sum of cross-sectional areas of the plurality of second inlet buffer communication holes 552 or the sum of cross-sectional areas of the plurality of third inlet buffer communication holes 553.

Therefore, the flow rate of water introduced into the tank space 420 through the first inlet buffer communication hole 551 may be greater than the flow rate of water introduced into the tank space 420 through the second inlet buffer communication hole 552 or the third inlet buffer communication hole 553.

As a result, a relatively large flow rate of water among the water introduced into the inlet buffer space 520 flows to the first inlet buffer communication hole 551 and then introduces into the tank space 420, so the length of the flow path of the water introduced into the tank space 420 may be increased.

The outlet buffer portion 600 is configured to extend the flow path of water that flows out of the tank space 420. The water heated in the tank space 420 may flow out into the outlet flow path portion 100 after passing through the outlet buffer portion 600. Accordingly, the flow rate and speed of the outflowed water are adjusted to ensure a sufficient contact time between the water introduced into the tank space 420 and the heater member 310, and as a result, the water may be sufficiently heated.

In addition, water that is heated and discharged from the tank space 420 may be sufficiently mixed before it is discharged to the outlet flow path portion 100. Therefore, the temperature distribution of water provided to the outside may be uniformly formed, and the satisfaction of the user may be improved.

The outlet buffer portion 600 is coupled to the cover portion 200. Specifically, one component of the outlet buffer portion 600 (i.e., the cover coupling portion 640 to be described later) is coupled to the outlet buffer coupling portion 240 of the cover portion 200.

The outlet buffer portion 600 communicates with the cover portion 200. Specifically, the space formed inside the outlet buffer portion 600 (i.e., the outlet buffer space 620 to be described later) communicates with the cover space 220 formed inside the cover portion 200. Accordingly, the outlet buffer portion 600 is also communicated with the outlet flow path portion 100, and the introduced water (i.e., heated water) may flow to the outlet flow path portion 100 via the outlet buffer portion 600.

The outlet buffer portion 600 is accommodated in the tank space 420. In addition, the outlet buffer portion 600 communicates with the tank space 420. The water heated in the tank space 420 may flow out to the outlet buffer portion 600.

At this time, the outlet buffer portion 600 is formed to change the size of the cross-sectional area of the component (i.e., the outlet buffer communication hole 630 to be described later) communicating with the tank space 420 according to the distance from the outlet opening 112 provided in the outlet flow path body 110 or the cover outlet hollow 231 provided in the cover 200. Specifically, the flow rate of water introduced into the outlet buffer portion 600 from the tank space 420 may be proportional to the distance to the outlet opening 112 or the cover outlet hollow 231.

Accordingly, the flow rate of water introduced into the outlet buffer portion 600 at a part close to the outlet opening 112 or the cover outlet hollow 231 may be greater than the flow rate of water introduced into the outlet buffer portion 600 at a part far from the outlet opening 112 or the cover outlet hollow 231. Therefore, a flow path of water that flows out from the tank space 420 to the outlet flow path portion 100 may extend.

Figure 15:
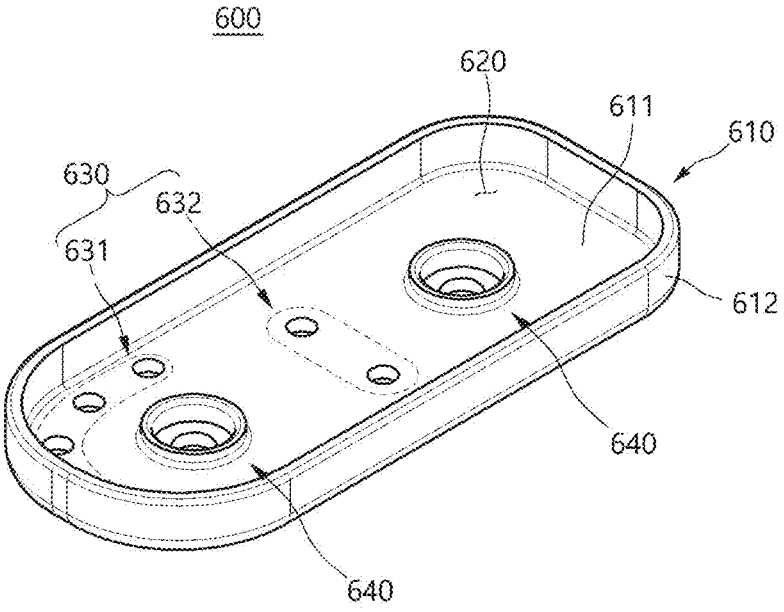
FIG. 15 is a perspective view illustrating an outlet buffer portion provided in the tank assembly of FIG. 2.
Figure 16:
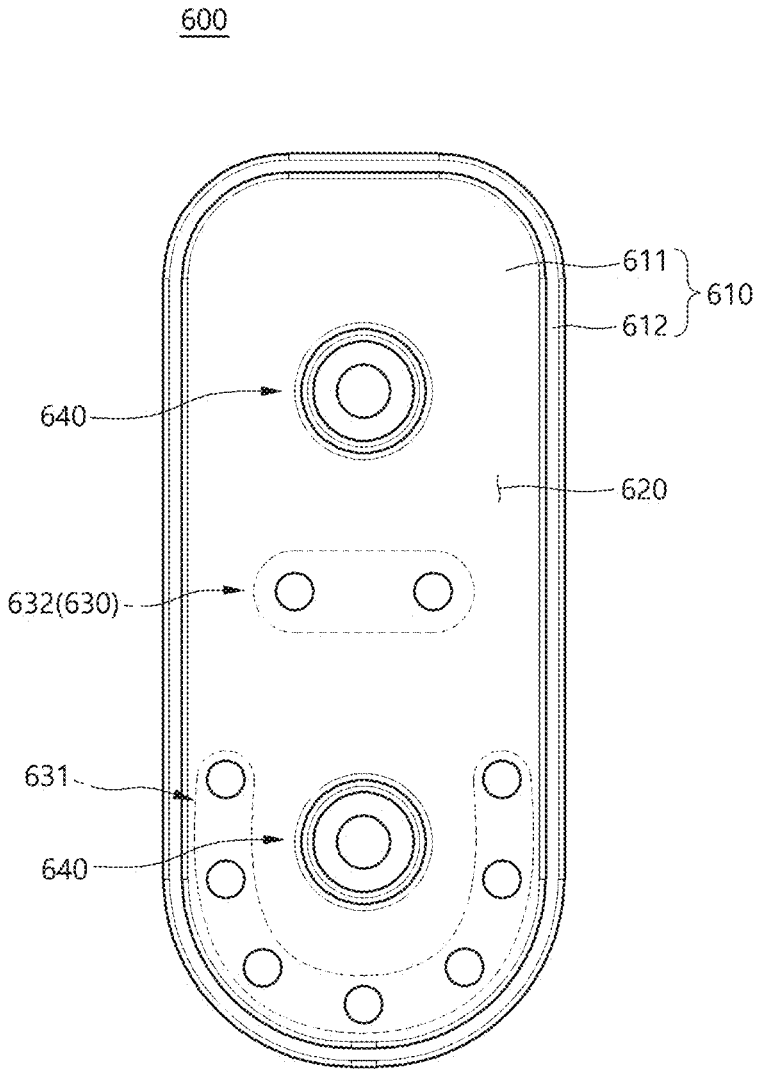
FIG. 16 is a plan view illustrating the outlet buffer portion of FIG. 15.
Figure 17:
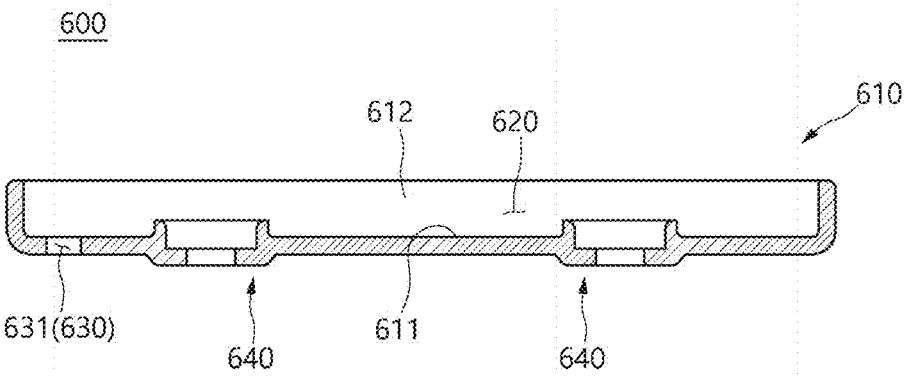
FIG. 17 is a side cross-sectional view illustrating the outlet buffer portion of FIG. 15.

In the embodiment illustrated in FIGS. 15 to 17, the outlet buffer portion 600 includes an outlet buffer body 610, an outlet buffer space 620, an outlet buffer communication hole 630, and a cover coupling portion 640.

The outlet buffer body 610 constitutes the body of the outlet buffer portion 600. Another component of the outlet buffer portion 600 is formed in the outlet buffer body 610. In the illustrated embodiment, the outlet buffer body 610 is provided with the outlet buffer space 620, the outlet buffer communication hole 630, and the cover coupling portion 640.

The outlet buffer body 610 may have a shape corresponding to the cover body 210 or the tank space 420. In the illustrated embodiment, the outlet buffer body 610 is formed in a plate shape with a length in the front and rear directions longer than a width in the left and right directions, and a thickness in the vertical direction. At this time, each end of the outlet buffer body 610 in the longitudinal direction, that is, the front side end and the rear side end in the illustrated embodiment, are rounded to be convex to the outside.

In an embodiment, the cross-section of the outlet buffer body 610 may be formed the same as the cross-section of the tank space 420. In the above embodiment, the outlet buffer body 610 may partition the cover space 220 and the tank space 420 in a height direction, that is, in a vertical direction. The partitioned cover space 220 and tank space 420 may communicate only through the outlet buffer communication hole 630 formed through the inside of the outlet buffer body 610.

In the illustrated embodiment, the outlet buffer body 610 includes an outlet buffer bottom surface 611 and an outlet buffer side surface 612.

The outlet buffer bottom surface 611 constitutes one surface of the outlet buffer body 610. In the illustrated embodiment, the outlet buffer bottom surface 611 constitutes one side of the outlet buffer body 610 in the height direction, that is, the lower side surface in the illustrated embodiment. The outlet buffer bottom surface 611 surrounds the outlet buffer space 620 formed inside the outlet buffer body 610 from the one side in the height direction, that is, the lower side.

An outlet buffer communication hole 630 is formed through the inside of the outlet buffer bottom surface 611. Also, a cover coupling portion 640 is formed inside the outlet buffer bottom 611.

The outlet buffer side surface 612 constitutes the other surface of the outlet buffer body 610. In the illustrated embodiment, the outlet buffer side surface 612 constitutes the outer circumference of the outlet buffer body 610.

The outlet buffer side surface 612 extends along the outer circumference of the outlet buffer bottom surface 611, and extends in the height direction of the outlet buffer body 610, that is, in the vertical direction in the illustrated embodiment. The outlet buffer side surface 612 surrounds the outlet buffer space 620 formed inside the outlet buffer body 610 in the horizontal direction.

One side of the outlet buffer side surface 612 in the height direction, that is, an upper end in the illustrated embodiment, are in contact with the lower side of the cover body 210. In an embodiment, the one end of the outlet buffer side surface 612 may be in close contact with the lower side of the cover body 210. Accordingly, the outlet buffer space 620 may communicate with the cover space 220, but may communicate with the tank space 420 only through the outlet buffer communication hole 630. That is, the outlet buffer space 620 is blocked from direct communication with the tank space 420.

The outlet buffer space 620 constitutes a flow path in which the water heated in the tank space 420 flows toward the outlet flow path portion 100. The outlet buffer space 620 communicates with the outlet opening 112, the cover space 220, and the tank space 420 of the outlet flow path portion 100, respectively.

The outlet buffer space 620 is formed inside the outlet buffer body 610. The outlet buffer space 620 is defined by being at least partially surrounded by the outlet buffer body 610. In the illustrated embodiment, one side, that is, the lower side of the outlet buffer space 620 in the height direction, is surrounded by the outlet buffer bottom surface 611. The horizontal direction of the outlet buffer space 620 is surrounded by the outlet buffer side surface 612.

The other side, that is, the upper side of the outlet buffer space 620 in the height direction, is open. The outlet buffer space 620 may communicate with the cover space 220 through the other side in the height direction.

The outlet buffer space 620 may have a shape corresponding to the shape of the outlet buffer body 610. In the illustrated embodiment, the outlet buffer space 620 is formed as a three-dimensional space with a length in the front and rear directions longer than the width in the left and right directions, and a height in the vertical direction.

The outlet buffer space 620 communicates with the tank space 420 through the outlet buffer communication hole 630.

The outlet buffer communication hole 630 communicates the outlet buffer space 620 with the tank space 420. The water heated in the tank space 420 may flow out into the outlet buffer space 620 only through the outlet buffer communication hole 630. Therefore, it may be said that the outlet buffer communication hole 630 communicates the outlet buffer space 620 with the tank space 420 indirectly.

The outlet buffer communication hole 630 is formed inside the outlet buffer body 610. Specifically, the outlet buffer communication hole 630 is formed through the inside of the outlet buffer bottom surface 611. The outlet buffer communication hole 630 is formed through the outlet buffer bottom surface 611 in the thickness direction, that is, in the vertical direction in the illustrated embodiment.

The outlet buffer communication hole 630 may be an arbitrary shape capable of communicating the outlet buffer space 620 with the tank space 420. In the illustrated embodiment, the outlet buffer communication hole 630 has a cylindrical space with a circular cross-section and a height in the vertical direction.

The outlet buffer communication hole 630 may be formed un plural. The plurality of outlet buffer communication holes 630 may be spaced apart and communicate the outlet buffer space 620 with the tank space 420 at different locations.

In this case, each outlet buffer communication hole 630 may be formed differently depending on the distance to the outlet opening 112 or the cover outlet hollow 231. Accordingly, the flow rate of water flowing from the tank space 420 to the outlet buffer space 620 may be different depending on the distance to the outlet opening 112 or the cover outlet hollow 231.

In the illustrated embodiment, the outlet buffer communication hole 630 includes a first outlet buffer communication hole 631 and a second outlet buffer communication hole 632.

The first outlet buffer communication hole 631 is located farthest from the outlet opening 112 or the cover outlet hollow 231. In other words, the first outlet buffer communication hole 631 is located on one side of the outlet buffer body 610 in the longitudinal direction, that is, on the front side in the illustrated embodiment, to be opposite to the outlet opening 112 or the cover outlet hollow 231.

The first outlet buffer communication hole 631 is disposed to face the second outlet buffer communication hole 632 with any one cover coupling portion 640 positioned on the front side along the longitudinal direction of the outlet buffer body 610 interposed therebetween.

The first outlet buffer communication hole 631 may be provided in plural. The plurality of first outlet buffer communication holes 631 may be disposed to be spaced apart from each other along the outer circumference of the outlet buffer body 610.

In the illustrated embodiment, a total of seven first outlet buffer communication holes 631 are formed, and are spaced apart from each other along the outer circumference of the front side of the outlet buffer body 610, that is, a part formed to be round, and a part formed to be continuous and linear with the same. The plurality of first outlet buffer communication holes 631 partially surround one of the cover coupling portions 640 in the radial direction.

The second outlet buffer communication hole 632 is located relatively closer to the outlet opening 112 or the cover outlet hollow 231 compared to the first outlet buffer communication hole 631. In other words, the second outlet buffer communication hole 632 is located on one side of the inlet buffer body 510 in the longitudinal direction, that is, on the rear side compared to the front side.

The second outlet buffer communication hole 632 is located between a pair of cover coupling portions 640 that are spaced apart from each other along the longitudinal direction of the outlet buffer body 610. The outlet buffer communication hole 632 is disposed to face the first outlet buffer communication hole 631 with any one of the cover coupling portions 640 located on the front side therebetween.

The second outlet buffer communication hole 632 may be provided in plural. The plurality of second outlet buffer communication holes 632 may be disposed inside the outlet buffer body 610 to be spaced apart from each other. In the illustrated embodiment, a total of two second outlet buffer communication holes 632 are formed, and are spaced apart in the width direction of the outlet buffer body 610, that is, in the left and right directions in the illustrated embodiment.

In this case, the sum of the cross-sectional areas of the plurality of first outlet buffer communication holes 631 may be greater than the sum of the cross-sectional areas of the plurality of second outlet buffer communication holes 632. Therefore, a relatively larger amount of water among the water heated in the tank space 420 may flow along a farther flow path to reach the cover outlet hollow 231.

In the illustrated embodiment, each of the first outlet buffer communication hole 631 and the second outlet buffer communication hole 632 is formed to have the same cross-sectional area. At this time, the number of first outlet buffer communication holes 631 is formed greater than the number of second outlet buffer communication holes 632.

Accordingly, the sum of the cross-sectional areas of the plurality of first outlet buffer communication holes 631 located on the front side of the outlet buffer body 610 is formed to be larger than the sum of the cross-sectional areas of the plurality of second outlet buffer communication holes 632 located on the rear side.

Alternatively, the cross-sectional area of each of the first outlet buffer communication holes 631 may be formed to be larger than that of each of the second outlet buffer communication holes 632. In the above embodiment, the number of the plurality of first outlet buffer communication holes 631 may be less than the number of the plurality of second outlet buffer communication holes 632.

In either case, the volume of the space in which the outflow buffer space 620 and the tank space 420 communicate with each other on the front side of the outlet buffer body 610, that is, at a point further away from the outflow opening 112 or the cover outflow hollow 231 is greater than the volume of the space in which the outflow buffer space 620 and the tank space 420 communicate with each other at a point closer to the outflow opening 112 or the cover outflow hollow 231.

Therefore, the flow rate of water introduced into the outlet buffer space 620 through the first outlet buffer communication hole 631 may be greater than the flow rate of water introduced into the outlet buffer space 620 through the second outlet buffer communication hole 632.

As a result, a relatively large flow rate of water flowing out of the tank space 420 flows through the first outlet buffer communication hole 631 to the outlet opening 112 or the cover outlet hollow 231 positioned opposite thereto, so that the length of the flow path of water flowing out of the tank space 420 may be increased.

The cover coupling portion 640 is a configuration in which the outlet buffer portion 600 is coupled to the cover portion 200. The cover coupling portion 640 at least partially accommodates the outlet buffer coupling portion 240 provided in the cover portion 200. The cover coupling portion 640 prevents arbitrary movement of the outlet buffer portion 600, and may block direct communication between the outlet buffer space 620 and the tank space 420.

The cover coupling portion 640 is formed on the outlet buffer body 610. Specifically, the cover coupling portion 640 is formed on the outlet buffer bottom surface 611. The cover coupling portion 640 is located in the outlet buffer space 620.

The cover coupling portion 640 may be an arbitrary shape that may be coupled to the outlet buffer coupling portion 240. In the illustrated embodiment, the cover coupling portion 640 is formed as a disc-shaped groove recessed downward with circular cross-section. Accordingly, a space capable of accommodating the outlet buffer coupling portion 240 may be formed inside the cover coupling portion 640. The cover coupling portion 640 may have a shape corresponding to the shape of the outlet buffer coupling portion 240.

The cover coupling portion 640 may be provided in plural. The plurality of cover coupling portions 640 may be spaced apart from each other and may be coupled to the plurality of outlet buffer coupling portions 240, respectively. In the illustrated embodiment, a pair of cover coupling portions 640 are provided to be spaced apart in the longitudinal direction, that is, the front and rear directions, of the outlet buffer body 610.

The number and arrangement method of the cover coupling portion 640 may be changed according to the number and arrangement method of the outlet buffer coupling portion 240.

Referring to FIGS. 18 to 23, a flow process of water formed inside the tank assembly 10 according to an embodiment of the present disclosure is illustrated as an example.

Figure 18:
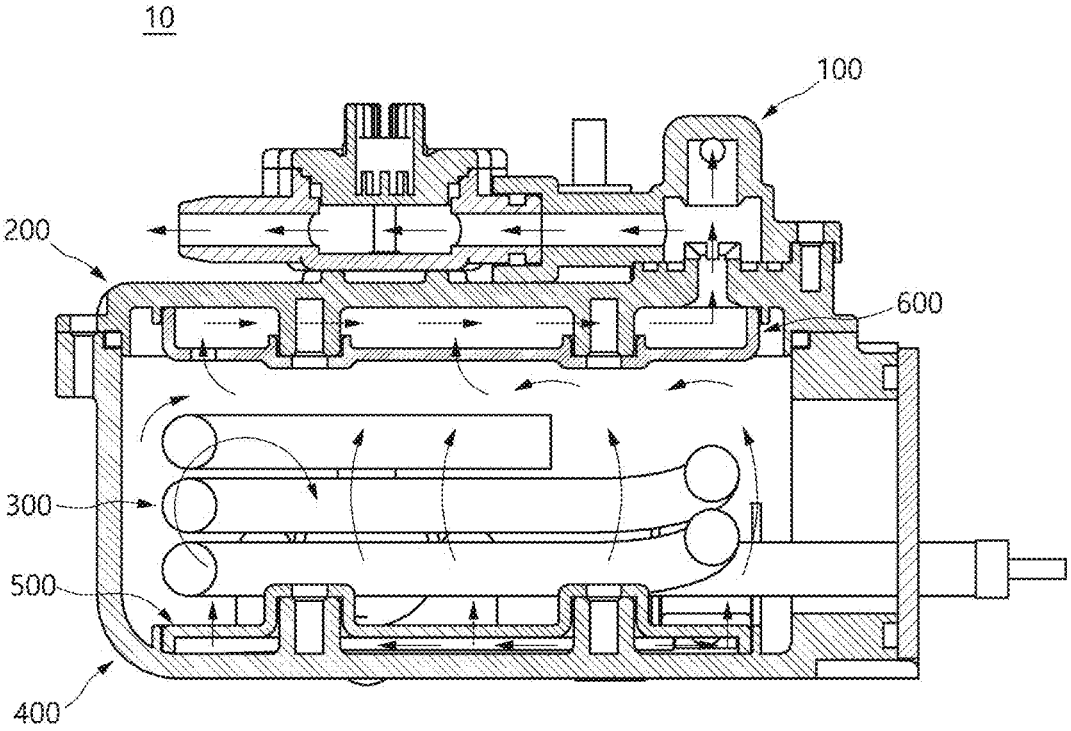
FIG. 18 is a side cross-sectional view illustrating a flow process of a fluid formed inside the tank assembly of FIG. 2.

Referring to FIG. 18, water provided from the fluid supply unit 20 is introduced into the tank space 420 through the inlet buffer portion 500.

At this time, the tank inlet coupling portion 530 fluidly connected to the fluid supply unit 20 is located at the rear side. The water introduced into the inlet buffer space 520 through the rear side flows toward the front side. The introduced water passes through any one of the first to third inlet buffer communication holes 551, 552, and 553 and is introduced into the tank space 420.

As described above, the sum of the cross-sectional areas of the first inlet buffer communication holes 551 is formed to be larger than the sum of the cross-sectional areas of the second inlet buffer communication holes 552 or the sum of the cross-sectional area of the third inlet buffer communication holes 553. Therefore, the largest amount of water flows out to the tank space 420 through the first inlet buffer communication hole 551 located at the frontmost side. Accordingly, the length of the water inlet flow path may increase.

The introduced water is heated by the heater member 310 located in the tank space 420. At this time, the introduced water may circulate in the tank space 420 for a certain period of time, and the contact time with the heater member 310 may increase. Accordingly, the heating efficiency of water may be improved.

The heated water flows through the outlet buffer communication hole 630 to the outlet flow path portion 100 through the outlet buffer space 620 (or the cover space 220 communicating therewith).

As described above, the sum of the cross-sectional areas of the first outlet buffer communication holes 631 is formed to be larger than the sum of the cross-sectional areas of the second outlet buffer communication holes 632. Therefore, the largest amount of water flows out of the tank space 420 through the first outlet buffer communication hole 631 located at the frontmost side. Accordingly, the length of the outlet flow path of water may increase.

Referring to FIGS. 19 to 23, a flow process of water formed in each component disposed in the height direction of the tank assembly 10 is illustrated as an example.

Figure 19:
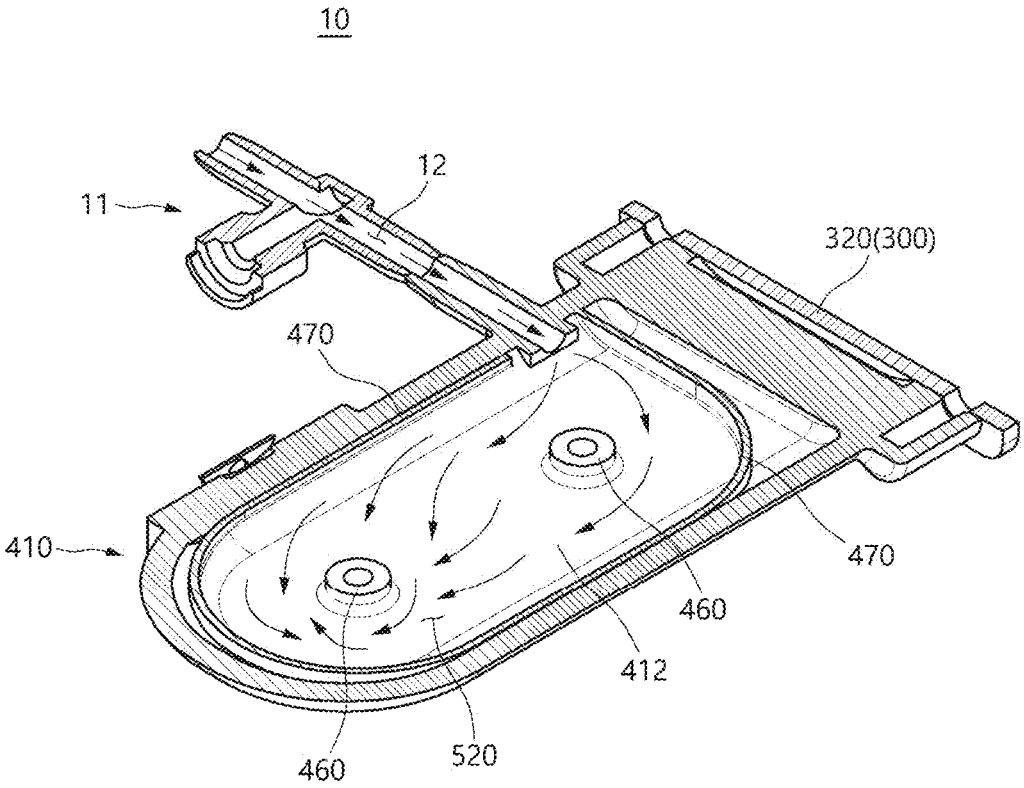
FIGS. 19 to 23 are plan cross-sectional views illustrating a flow process of a fluid formed inside the tank assembly of FIG. 2.

Referring to FIG. 19, the water provided in the fluid supply unit 20 is transmitted to the tank member 400 through the inlet flow path portion 11. In this case, the inlet flow path portion 11 is introduced into the tank space 420 through the tank inlet pipe member 430 located at the rear side of the tank body 410 and the tank inlet coupling portion 530 communicating therewith.

An inlet buffer portion 500 is located in the tank space 420. As described above, the inlet buffer portion 500 partitions the tank space 420 along the height direction, and the introduced water flows into the inlet buffer space 520. The introduced water flows along the inlet buffer space 520.

Figure 20:
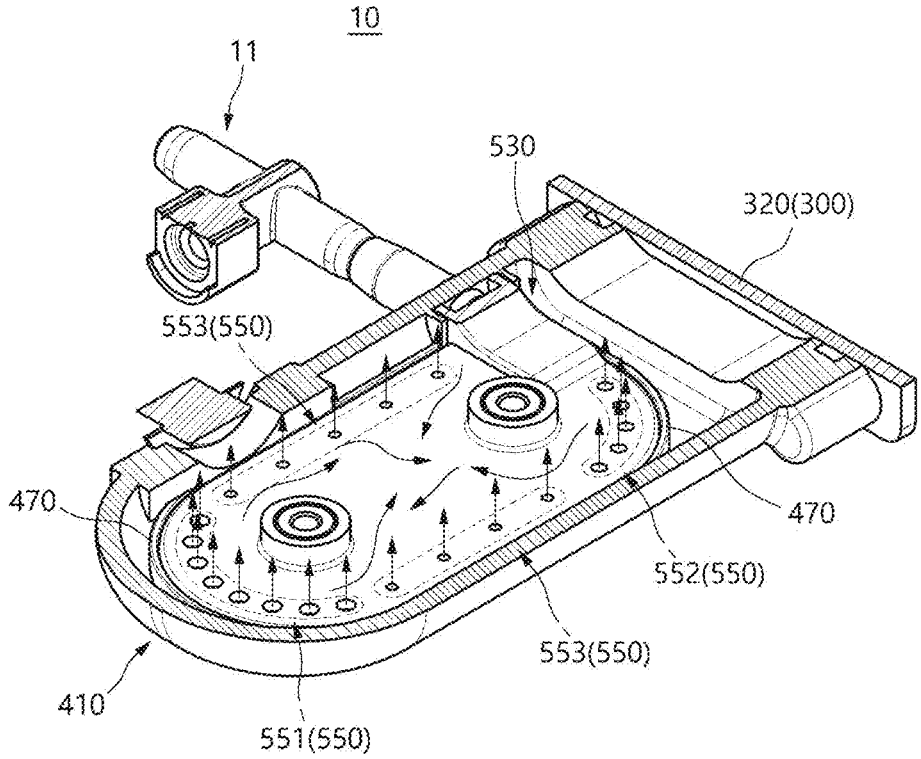

Referring to FIG. 20, the water introduced into the inlet buffer space 520 flows out to the tank space 420 through at least one of the first to third inlet buffer communication holes 551, 552, and 553.

At this time, the sum of the cross-sectional areas of the first inlet buffer communication holes 551 located farthest from the tank inlet coupling portion 530 is formed to be the largest. Therefore, among the water flowing in the inlet buffer space 520, the largest amount of water may flow longest and may flow out to the tank space 420 through the first inlet buffer communication hole 551.

In addition, the remainder of the water introduced into the inlet buffer space 520 flows out to the tank space 420 through at least one of the second to third inlet buffer communication holes 552 and 553, respectively.

Figure 21:
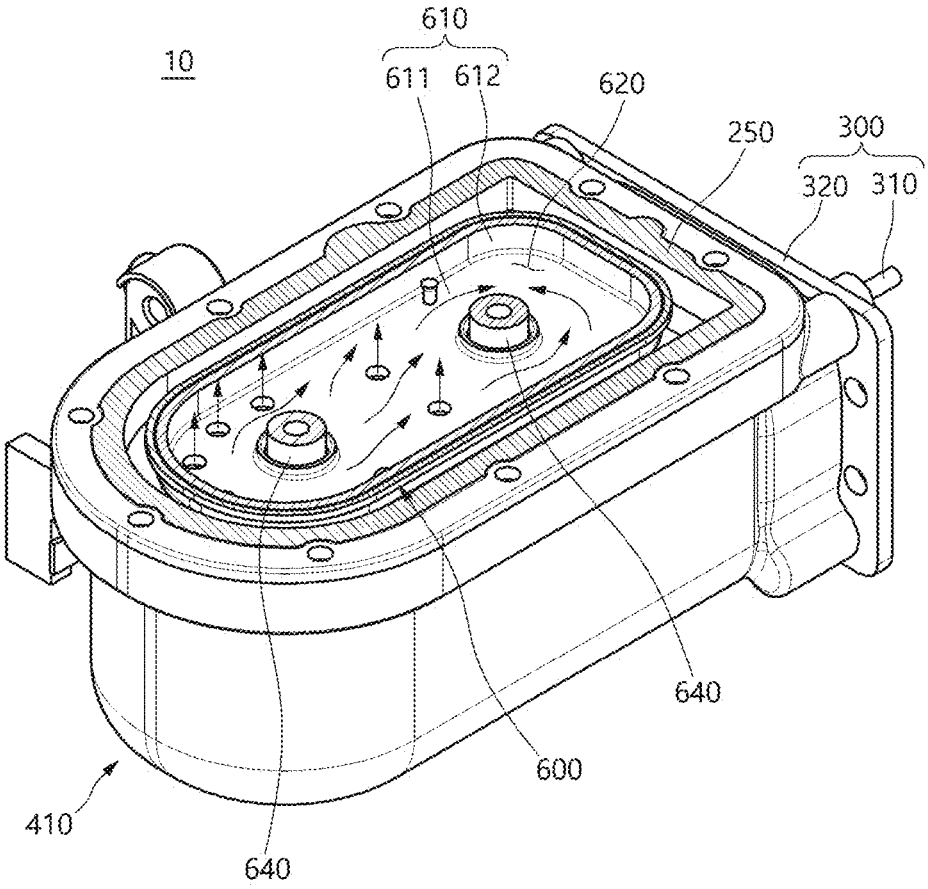

Referring to FIG. 21, the heated water flowing in the tank space 420 flows out into the outlet buffer space 620 (or cover space 220 communicating therewith) through at least one of the first to second outlet buffer communication holes 631 and 632.

In this case, the sum of the cross-sectional areas of the first outlet buffer communication holes 631 located farthest from the outlet opening 112 or the cover outlet hollow 231 is formed to be larger than the sum of the cross-sectional areas of the second outlet buffer communication holes 632 located closer to the outlet opening 112 or the cover outlet hollow 231.

Therefore, the largest amount of water among the water heated in the tank space 420 may be introduced into the outlet buffer space 620 through the first outlet buffer communication hole 631. The water passing through the first outlet buffer communication hole 631 flows long along the longitudinal direction of the outlet buffer space 620 toward the outlet opening 112 or the cover outlet hollow 231.

In addition, the remainder of the water heated in the tank space 420 may be introduced into the outlet buffer space 620 through the second outlet buffer communication hole 632. The water passing through the second outlet buffer communication hole 632 flows toward the outlet opening 112 or the cover outlet hollow 231 along the longitudinal direction of the outlet buffer space 620.

In the illustrated embodiment, the water heated in the tank space 420 must flow a distance of at least half the length of the outflow buffer space 620 to reach the outlet opening 112 or the cover outlet hollow 231. Therefore, the length of the flow path of the outflowed water may be increased, and the flow rate and speed of the outflowed water may be adjusted.

Accordingly, the residence time of the water introduced into the tank space 420 may increase, and the contact time with the heater member 310 may increase, and the heating efficiency of the water may be improved. In addition, since the outflowed water is mixed and discharged in the outlet buffer space 620, the temperature of the outflowed water may be uniformly formed.

Figure 22:
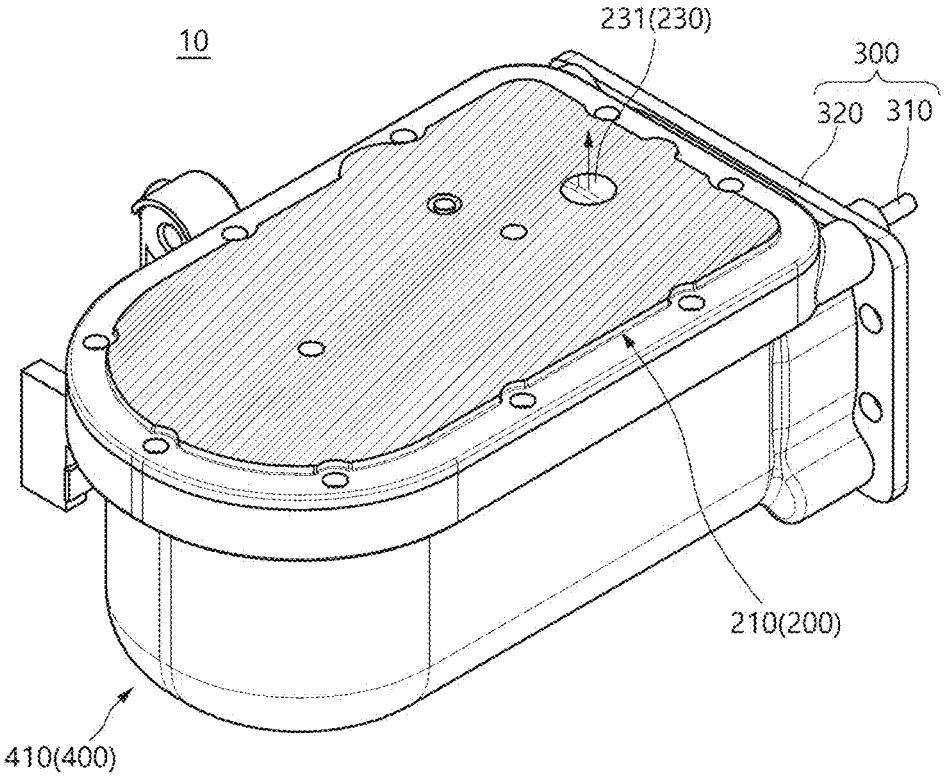

Referring to FIG. 22, the water flowing in the outlet buffer space 620 is discharged through the cover outlet hollow 231. As described above, the outlet buffer space 620 communicates with the tank space 420 through the outlet buffer communication hole 630 disposed to be spaced apart from the cover outlet hollow 231 along its longitudinal direction.

Therefore, it will be understood that the heated water flows along a sufficiently long flow path and then is discharged through the cover outlet hollow 231.

Figure 23:
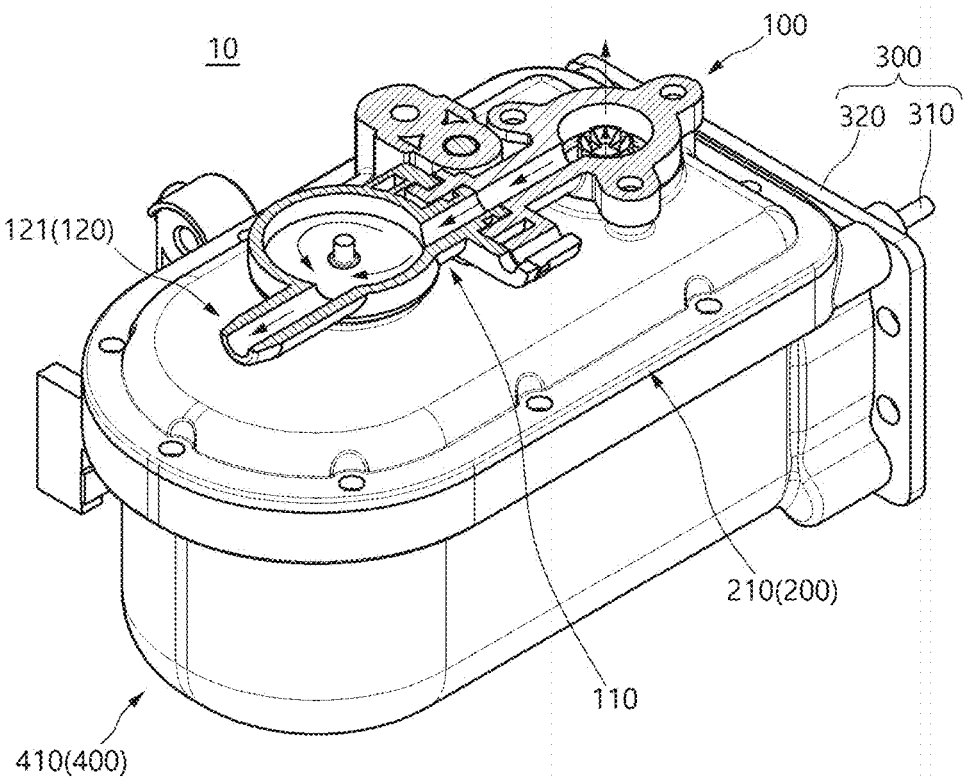

Referring to FIG. 23, the water flowing out through the cover outlet hollow 231 flows through the outlet flow path portion 100 and is provided to the outside. In this case, a part of the water passing through the cover outlet hollow 231 may be transmitted to the fluid injection unit 30 via the second outlet pipe member 122 located more adjacently. In addition, the remainder of the water passing through the cover outlet hollow 231 may be transmitted to the fluid injection unit 30 via the first outlet pipe member 121 located at the front side after flowing along the outlet flow path body hollow 111.

Although exemplary embodiments of the present disclosure have been described, the idea of the present disclosure is not limited to the embodiments set forth herein. Those of ordinary skill in the art who understand the idea of the present disclosure may easily propose other embodiments through supplement, change, removal, addition, etc. of elements within the same idea, but the embodiments will be also within the scope of the present disclosure.

LIST OF REFERENCE SIGNS

1: bidet
10: tank assembly
11: inlet flow path portion
12: inlet flow path hollow
20: fluid supply unit
30: fluid injection unit
100: outlet flow path portion
110: outlet flow path body
111: outlet flow path body hollow
112: outlet opening
120: outlet pipe member
121: first outlet pipe member
**121*a***: first outlet pipe hollow
122: second outlet pipe member
**122*a***: second outlet pipe hollow
130: sensor coupling portion
200: cover portion
210: cover body
211: cover upper surface
212: cover side surface
220: cover space
230: outlet flow path coupling portion
231: cover outlet hollow
240: outlet buffer coupling portion
250: sealing member
300: heater portion
310: heater member
320: heater support plate
400: tank member

410: tank body
411: tank side surface
412: tank bottom surface
420: tank space
430: tank inlet pipe member
431: tank inlet hollow
440: heater insertion opening
450: drain opening
460: inlet buffer coupling portion
470: inlet buffer support rib
500: inlet buffer portion
510: inlet buffer body
520: inlet buffer space
530: tank inlet coupling portion
531: inlet buffer hollow
540: tank coupling portion
550: inlet buffer communication hole
551: first inlet buffer communication hole
552: second inlet buffer communication hole
553: third inlet buffer communication hole
600: outlet buffer portion
610: outlet buffer body
611: outlet buffer bottom surface
612: outlet buffer side surface
620: outlet buffer space
630: outlet buffer communication hole 631: first outlet buffer communication hole
632: second outlet buffer communication hole
640: cover coupling portion

What is claimed is:

1. A tank assembly comprising:

a tank member that is connected to an outside, constitutes an inlet flow path through which a fluid is introduced, and has one side in a height direction open;

a cover portion that is connected to the outside, constitutes an outlet flow path of the fluid introduced into an inside, covers the one side of the tank member, and is coupled to the tank member; and an outlet buffer portion that is coupled to the cover portion to constitute the outlet flow path of the fluid together with the cover portion, and is accommodated in the tank member to be located at the one side of the tank member, wherein the outlet buffer portion comprises:

an outlet buffer space communicated with a cover space formed inside the cover portion; and an outlet buffer communication hole communicating the outlet buffer space with a tank space formed inside the tank member, wherein the cover portion comprises a cover outlet hollow that is formed through in the height direction and communicates the cover space with the outside, and wherein the cover outlet hollow and the outlet buffer communication hole are positioned opposite to each other along a flow direction of the fluid, the fluid introduced into an interior of the tank member flows into the cover portion only after passing through the outlet buffer communication hole, the outlet buffer space, and the cover outlet hollow in sequence.

2. The tank assembly of claim 1, further comprising:

an outlet buffer body surrounding the outlet buffer space, wherein the outlet buffer communication hole is formed through a part of the outlet buffer body.

3. The tank assembly of claim 2, wherein the cover portion is connected to the outside at one side in its longitudinal direction, and the outlet buffer communication hole is formed at the other side in the longitudinal direction, wherein the fluid introduced into the outlet buffer space by passing through the outlet buffer communication hole flows from the other side to the one side along the longitudinal direction, and then flows out to the outside.

4. The tank assembly of claim 2, wherein the cover portion is connected to the outside at one side in its longitudinal direction, and the outlet buffer communication hole is formed in plural, and the plurality of outlet buffer communication holes are disposed to be spaced apart from each other in the longitudinal direction, wherein a sum of cross-sectional areas of a part of the outlet buffer communication holes disposed at the one side in the longitudinal direction is less than or equal to a sum of cross-sectional areas of a remaining outlet buffer communication holes disposed at the other side in the longitudinal direction.

5. The tank assembly of claim 2, wherein the cover portion is connected to the outside at one side in its longitudinal direction, and the outlet buffer communication hole is formed in plural, and the plurality of outlet buffer communication holes are disposed to be spaced apart from each other in the longitudinal direction, wherein a number of the outlet buffer communication holes disposed at one side in the longitudinal direction is less than or equal to a number of the outlet buffer communication holes disposed at the other side in the longitudinal direction.

6. The tank assembly of claim 1, the tank assembly comprising:

a heater portion coupled to the tank member, and configured to heat the fluid introduced into the tank space, wherein the tank member comprises a tank inlet pipe member located at the other side in the height direction and connected to the outside to constitute the inlet flow path of the fluid, wherein the heater portion is located between the tank inlet pipe member and the outlet buffer portion in the height direction.

7. The tank assembly of claim 6, wherein the tank inlet pipe member is located at the one side of the tank member in the longitudinal direction, wherein the outlet buffer communication hole is formed in plural, and the plurality of outlet buffer communication holes are disposed to be spaced apart from each other in a longitudinal direction, wherein a sum of cross-sectional areas of a part of the outlet buffer communication holes disposed at the one side in the longitudinal direction is less than or equal to a sum of cross-sectional areas of the remaining outlet buffer communication holes disposed at the other side in the longitudinal direction.

8. The tank assembly of claim 1, wherein the cover portion comprises:

a cover body surrounding the cover space at the one side in the height direction and in a horizontal direction; and an outlet flow path coupling portion located at the one side of the cover body in a longitudinal direction, and coupled to an inlet flow path portion, and communicating the inlet flow path portion with the cover space.

9. The tank assembly of claim 8, further comprising:

a heater portion coupled to the tank member, and configured to heat the fluid introduced into the tank space, wherein the cover outlet hollow is formed inside the outlet flow path coupling portion, and wherein the time for the fluid introduced into the tank space to be heated by the heater portion is increased as much as time for the fluid to flow a distance between the outlet buffer communication hole and the cover outlet hollow.

10. The tank assembly of claim 1, further comprising:

an inlet buffer portion accommodated in the tank space to be located at the other side of the tank member in the height direction, and connected to the outside to constitute the inlet flow path of the fluid, wherein the inlet buffer portion comprises:

a tank inlet coupling portion connected to the outside;

an inlet buffer body located to be spaced apart from the other side of the tank member in the height direction; and an inlet buffer space formed between the inlet buffer body and the other side of the tank member, and connected to the tank inlet coupling portion and the tank space.

11. The tank assembly of claim 10, wherein the inlet buffer portion comprises an inlet buffer communication hole formed through inside of the inlet buffer body, and communicating the inlet buffer space with the tank space.

12. The tank assembly of claim 11, wherein the tank inlet coupling portion is located on one side of the inlet buffer body in the longitudinal direction, and the inlet buffer communication hole is provided in plural, and the plurality of inlet buffer communication holes are disposed to be spaced apart from each other along a longitudinal direction, and a sum of cross-sectional areas of a part of the inlet buffer communication holes disposed at the one side in the longitudinal direction is less than or equal to a sum of cross-sectional areas of the remaining inlet buffer communication holes disposed at the other side in the longitudinal direction.

13. The tank assembly of claim 10, wherein the tank member comprises an inlet buffer support rib extending from the other side of the tank member in the height direction, and supporting the inlet buffer body.

14. A bidet comprising:

the tank assembly according to claim 1;

a fluid supply unit connected to the tank assembly and the outside, respectively, to constitute the inlet flow path of the fluid; and a fluid injection unit connected to the tank assembly and the outside, respectively, to constitute the outlet flow path of the fluid.

* * * * *